US009955276B2

(12) United States Patent
Purnhagen et al.

(10) Patent No.: US 9,955,276 B2
(45) Date of Patent: Apr. 24, 2018

(54) PARAMETRIC ENCODING AND DECODING OF MULTICHANNEL AUDIO SIGNALS

(71) Applicant: DOLBY INTERNATIONAL AB, Amsterdam Zuidoost (NL)

(72) Inventors: Heiko Purnhagen, Sundbyberg (SE); Heidi-Maria Lehtonen, Sollentuna (SE); Janusz Klejsa, Bromma (SE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 15/521,157

(22) PCT Filed: Oct. 29, 2015

(86) PCT No.: PCT/EP2015/075115

§ 371 (c)(1),
(2) Date: Apr. 21, 2017

(87) PCT Pub. No.: WO2016/066743

PCT Pub. Date: May 6, 2016

(65) Prior Publication Data

US 2017/0339505 A1 Nov. 23, 2017

Related U.S. Application Data

(60) Provisional application No. 62/073,642, filed on Oct. 31, 2014, provisional application No. 62/128,425, filed on Mar. 4, 2015.

(51) Int. Cl.
*H04R 5/00* (2006.01)
*H04S 3/00* (2006.01)
(Continued)

(52) U.S. Cl.
CPC ..... *H04S 3/008* (2013.01); *G10L 19/008* (2013.01); *G10L 19/22* (2013.01); *H04S 7/00* (2013.01);
(Continued)

(58) Field of Classification Search
CPC .. H04S 3/008; H04S 2400/03; H04S 2420/03; H04S 7/00; G10L 19/008; G10L 19/22
See application file for complete search history.

(56) References Cited

U.S. PATENT DOCUMENTS 7,356,465 B2 4/2008 Tsingos
8,200,500 B2 6/2012 Baumgarte
(Continued)

FOREIGN PATENT DOCUMENTS

EP 2360681 8/2011
EP 2741286 6/2014
(Continued)

OTHER PUBLICATIONS

Mouchtaris, A. et al "Low Bitrate Coding of Spot Audio Signals for Interactive and Immersive Audio Applications" Springer-Verlag Berlin Heidelberg, Department of Computer Science, 2008, pp. 155-164.

(Continued)

*Primary Examiner* — Andrew L Sniezek

(57) ABSTRACT

A control section (1009) receives signaling (S) indicating one of at least two coding formats ($F_1$, $F_2$, $F_3$) of an M-channel audio signal (L, LS, LB, TFL, TBL), the coding formats corresponding to different partitions of the channels of the audio signal into respective first and second groups (601, 602), wherein, in the indicated coding format, first and second channels ($L_1$, $L_2$) of a downmix signal correspond to linear combinations of the first and second groups, respectively; and a decoding section (900) reconstructs the audio
(Continued)

signal based on the downmix signal and associated upmix parameters ($\alpha_L$). In the decoding section: a decorrelation input signal ($D_1$, $D_2$, $D_3$) is determined based on the downmix signal and the indicated coding format; and wet and dry upmix coefficients, controlling linear mappings of the downmix signal and a decorrelated signal, generated based on the decorrelation input signal, are determined based on the upmix parameters and the indicated coding format.

20 Claims, 7 Drawing Sheets

(51) Int. Cl.
*G10L 19/008* (2013.01)
*G10L 19/22* (2013.01)
*H04S 7/00* (2006.01)

(52) U.S. Cl.
CPC ..... *H04S 2400/03* (2013.01); *H04S 2420/03* (2013.01)

(56) References Cited

U.S. PATENT DOCUMENTS

| | | | |
|---|---|---|---|
| 2006/0165247 | A1 | 7/2006 | Mansfield |
| 2006/0239473 | A1 | 10/2006 | Kjorling |
| 2007/0121954 | A1 | 5/2007 | Kim |
| 2008/0255856 | A1 | 10/2008 | Schuijers |
| 2009/0234657 | A1 | 9/2009 | Takagi |
| 2011/0224994 | A1 | 9/2011 | Norvell |
| 2011/0255714 | A1 | 10/2011 | Neusinger |
| 2012/0170756 | A1 | 7/2012 | Kraemer |
| 2012/0232910 | A1 | 9/2012 | Dressler |
| 2013/0222690 | A1 | 8/2013 | Kim |
| 2014/0016802 | A1 | 1/2014 | Sen |
| 2014/0023196 | A1 | 1/2014 | Xiang |
| 2014/0086414 | A1 | 3/2014 | Vilermo |
| 2014/0133683 | A1 | 5/2014 | Robinson |
| 2014/0219455 | A1 | 8/2014 | Peters |
| 2016/0247514 | A1 | 8/2016 | Villemoes |
| 2017/0332185 | A1* | 11/2017 | Villemoes ..... H04S 3/008 |

FOREIGN PATENT DOCUMENTS

| | | |
|---|---|---|
| WO | 2014/035902 | 3/2014 |
| WO | 2014/036121 | 3/2014 |
| WO | 2014/041067 | 3/2014 |
| WO | 2014/068583 | 5/2014 |
| WO | 2016/066705 | 5/2016 |

OTHER PUBLICATIONS

Liebchen, T. et al. "The MPEG-4 Audio Lossless Coding (ALS) Standard—Technology and Applications" AES, presented at the 119th Convention, Oct. 7-10, 2005, New York, USA, pp. 1-14.

Hu, R. et al "Perceptual Characteristic and Compression Research in 3D Audio Technology" 9th International Symposium on Computer Music Modelling and Retrieval Queen Mary University of London, Jun. 19-22, 2012, pp. 241-256.

Tzagkarakis, C. et al "Modeling and Coding of Spot Microphone Signals for Immersive Audio Based on the Sinusoidal Model" Department of Computer Science, University of Crete and Institute of Computer Science, Dec. 1, 2008, pp. 1-5.

"ISO/IEC 23003-1:2006, MPEG Surround" MPEG Meeting Jul. 17-21, 2006, Klagenfurt, ISO/IEC JTC1/SC29/WG11.

"ETSI TS 103 190-2: JTC-029-2v002" ETSI Draft JTC-029-2V002, European Telecommunications Standard Institute, Apr. 30, 2015, pp. 1-223.

* cited by examiner

PARAMETRIC ENCODING AND DECODING OF MULTICHANNEL AUDIO SIGNALS

CROSS REFERENCE TO RELATED APPLICATIONS

This application claims priority to U.S. Provisional Patent Application No. 62/073,642, filed on Oct. 31, 2014 and U.S. Provisional Patent Application No. 62/128,425, filed on Mar. 4, 2015, each of which is hereby incorporated by reference in its entirety.

TECHNICAL FIELD

The invention disclosed herein generally relates to parametric encoding and decoding of audio signals, and in particular to parametric encoding and decoding of channel-based audio signals.

BACKGROUND

Audio playback systems comprising multiple loudspeakers are frequently used to reproduce an audio scene represented by a multichannel audio signal, wherein the respective channels of the multichannel audio signal are played back on respective loudspeakers. The multichannel audio signal may for example have been recorded via a plurality of acoustic transducers or may have been generated by audio authoring equipment. In many situations, there are bandwidth limitations for transmitting the audio signal to the playback equipment and/or limited space for storing the audio signal in a computer memory or in a portable storage device. There exist audio coding systems for parametric coding of audio signals, so as to reduce the bandwidth or storage size. On an encoder side, these systems typically downmix the multichannel audio signal into a downmix signal, which typically is a mono (one channel) or a stereo (two channels) downmix, and extract side information describing the properties of the channels by means of parameters like level differences and cross-correlation. The downmix and the side information are then encoded and sent to a decoder side. On the decoder side, the multichannel audio signal is reconstructed, i.e. approximated, from the downmix under control of the parameters of the side information.

In view of the wide range of different types of devices and systems available for play-back of multichannel audio content, including an emerging segment aimed at end-users in their homes, there is a need for new and alternative ways to efficiently encode multichannel audio content, so as to reduce bandwidth requirements and/or the required memory size for storage, facilitate reconstruction of the multichannel audio signal at a decoder side, and/or increase fidelity of the multichannel audio signal as reconstructed at a decoder side.

BRIEF DESCRIPTION OF THE DRAWINGS

In what follows, example embodiments will be described in greater detail and with reference to the accompanying drawings, on which.

Figure 1:
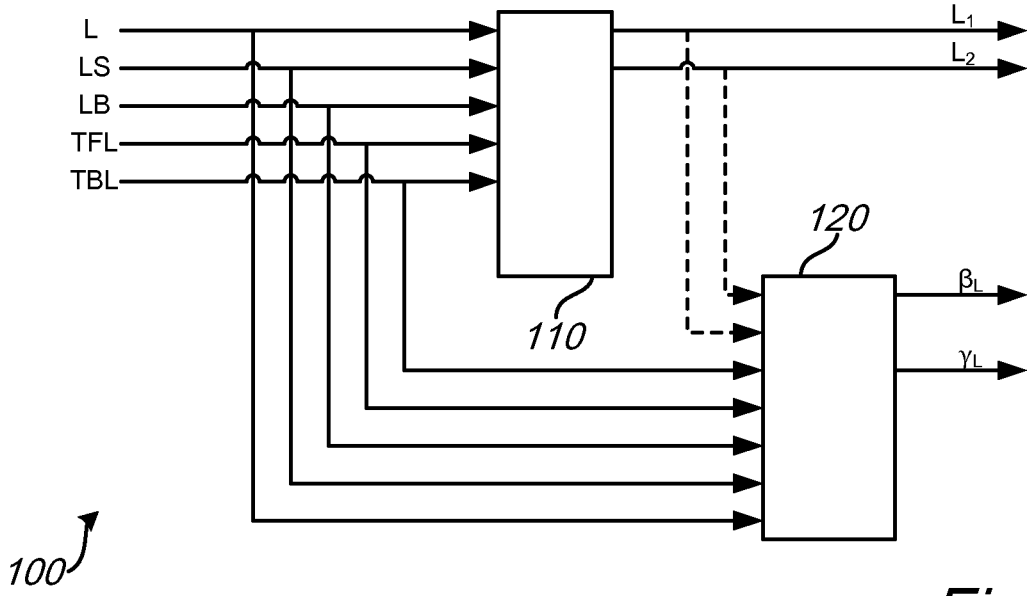
FIGS. 1 and 2 are generalized block diagrams of encoding sections for encoding M-channel audio signals as two-channel downmix signals and associated upmix parameters, according to example embodiments.

All the figures are schematic and generally only show parts which are necessary in order to elucidate the invention, whereas other parts may be omitted or merely suggested.

DESCRIPTION OF EXAMPLE EMBODIMENTS

As used herein, an audio signal may be a standalone audio signal, an audio part of an audiovisual signal or multimedia signal or any of these in combination with metadata. As used herein, a channel is an audio signal associated with a predefined/fixed spatial position/orientation or an undefined spatial position such as "left" or "right".

I. Overview—Decoder Side

According to a first aspect, example embodiments propose audio decoding systems, audio decoding methods and associated computer program products. The proposed decoding systems, methods and computer program products, according to the first aspect, may generally share the same features and advantages.

According to example embodiments, there is provided an audio decoding method which comprises receiving a two-channel downmix signal and upmix parameters for parametric reconstruction of an M-channel audio signal based on the downmix signal, where $M \geq 4$. The audio decoding method comprises receiving signaling indicating a selected one of at least two coding formats of the M-channel audio signal, where the coding formats correspond to respective different partitions of the channels of the M-channel audio signal into respective first and second groups of one or more channels. In the indicated coding format, a first channel of the downmix signal corresponds to a linear combination of the first group of one or more channels of the M-channel audio signal, and a second channel of the downmix signal corresponds to a linear combination of the second group of one or more channels of the M-channel audio signal. The audio decoding method further comprises: determining a set of pre-decorrelation coefficients based on the indicated coding format; computing a decorrelation input signal as a linear mapping of the downmix signal, wherein the set of pre-decorrelation coefficients is applied to the downmix signal; generating a decorrelated signal based on the decorrelation input signal; determining sets of upmix coefficients of a first type, referred to herein as wet upmix coefficients, and of a second type, referred to herein as dry upmix coefficients, based on the received upmix parameters and the indicated coding format; computing an upmix signal of a first type, referred to herein as a dry upmix signal, as a linear mapping of the downmix signal, wherein the set of dry upmix coefficients is applied to the downmix signal; computing an upmix signal of a second type, referred to herein as a wet upmix signal, as a linear mapping of the decorrelated signal, wherein the set of wet upmix coefficients is applied to the decorrelated signal; and combining the dry and wet upmix signals to obtain a multidimensional reconstructed signal corresponding to the M-channel audio signal to be reconstructed.

Depending on the audio content of the M-channel audio signal, different partitions of the channels of the M-channel audio signal into first and second groups, wherein each group contributes to a channel of the downmix signal, may be suitable for, e.g. facilitating reconstruction of the M-channel audio signal from the downmix signal, improving (perceived) fidelity of the M-channel audio signal as reconstructed from the downmix signal, and/or improving coding efficiency of the downmix signal. The ability of the audio decoding method to receive signaling indicating a selected one of the coding formats, and to adapt determination of the pre-decorrelation coefficients as well as of the wet and dry upmix coefficients to the indicated coding format, allows for a coding format to be selected on an encoder side, e.g. based on the audio content of the M-channel audio signal, for exploiting comparative advantages of employing that particular coding format to represent the M-channel audio signal.

In particular, determining the pre-decorrelation coefficients based on the indicated coding format may allow for the channel, or channels, of the downmix signal, from which the decorrelated signal is generated, to be selected and/or weighted, based on the indicated coding format, before generating the decorrelated signal. The ability of the audio decoding method to determine the pre-decorrelation coefficients differently for different coding formats may therefore allow for improving fidelity of the M-channel audio signal as reconstructed.

The first channel of the downmix signal may for example have been formed, e.g. on an encoder side, as a linear combination of the first group of one or more channels, in accordance with the indicated coding format. Similarly, the second channel of the downmix signal may for example have been formed, on an encoder side, as a linear combination of the second group of one or more channels, in accordance with the indicated coding format.

The channels of the M-channel audio signal may for example form a subset of a larger number of channels together representing a sound field.

The decorrelated signal serves to increase the dimensionality of the audio content of the downmix signal, as perceived by a listener. Generating the decorrelated signal may for example include applying a linear filter to the decorrelation input signal.

By the decorrelation input signal being computed as a linear mapping of the downmix signal is meant that the decorrelation input signal is obtained by applying a first linear transformation to the downmix signal. This first linear transformation takes the two channels of the downmix signal as input and provides the channels of the decorrelation input signal as output, and the pre-decorrelation coefficients are coefficients defining the quantitative properties of this first linear transformation.

By the dry upmix signal being computed as a linear mapping of the downmix signal is meant that the dry upmix signal is obtained by applying a second linear transformation to the downmix signal. This second linear transformation takes the two channels of the downmix signal as input and provides M channels as output, and the dry upmix coefficients are coefficients defining the quantitative properties of this second linear transformation.

By the wet upmix signal being computed as a linear mapping of the decorrelated signal is meant that the wet upmix signal is obtained by applying a third linear transformation to the decorrelated signal. This third linear transformation takes the channels of the decorrelated signal as input and provides M channels as output, and the wet upmix coefficients are coefficients defining the quantitative properties of this third linear transformation.

Combining the dry and wet upmix signals may include adding audio content from respective channels of the dry upmix signal to audio content of the respective corresponding channels of the wet upmix signal, e.g. employing additive mixing on a per-sample or per-transform-coefficient basis.

The signaling may for example be received together with the downmix signal and/or the upmix parameters. The downmix signal, the upmix parameters and the signaling may for example be extracted from a bitstream.

In an example embodiment, it may hold that $M=5$, i.e. the M-channel audio signal may be a five-channel audio signal. The audio decoding method of the present example embodiment may for example be employed for reconstructing the five regular channels in one of the currently established 5.1 audio formats from a two-channel downmix of those five channels, or for reconstructing five channels on the left-hand side, or on right-hand side, in an 11.1 multichannel audio signal, from a two-channel downmix of those five channels. Alternatively, it may hold that $M=4$, or $M\geq 6$.

In an example embodiment, the decorrelation input signal and the decorrelated signal may each comprise $M-2$ channels. In the present example embodiment, a channel of the decorrelated signal may be generated based on no more than one channel of the decorrelation input signal. For example, each channel of the decorrelated signal may be generated based on no more than one channel of the decorreation input signal, but different channels of the decorrelated signal may for example be generated based on different channels of the decorrelation input signal.

In the present example embodiment, the pre-decorrelation coefficients may be determined such that, in each of the coding formats, a channel of the decorrelation input signal receives contribution from no more than one channel of the downmix signal. For example, the pre-decorrelation coefficients may be determined such that, in each of the coding formats, each channel of the decorrelation input signal coincides with a channel of the downmix signal. However, it will be appreciated that at least some of the channels of the decorrelated input signal may for example coincide with different channels of the downmix signal in a given coding format and/or in the different coding formats.

Since, in each given coding format, the two channels of the downmix signal represent disjoint first and second groups of one or more channels, the first group may be reconstructed from the first channel of the downmix signal, e.g. employing one or more channels of the decorrelated signal generated based on the first channel of the downmix signal, while the second group may be reconstructed from the second channel of the downmix signal, e.g. employing one or more channels of the decorrelated signal generated based on the second channel of the downmix signal. In the present example embodiment, contribution from the second group of one or more channels, to a reconstructed version of the first group of one or more channels, via the decorrelated signal, may be avoided in each coding format. Similarly, contribution from the first group of one or more channels, to a reconstructed version of the second group of one or more channels, via the decorrelated signal, may be avoided in each coding format. The present example embodiment may therefore allow for increasing the fidelity of the M-channel audio signal as reconstructed.

In an example embodiment, the pre-decorrelation coefficients may be determined such that a first channel of the M-channel audio signal contributes, via the downmix signal, to a first fixed channel of the decorrelation input signal in at least two of the coding formats. This is to say, the first channel of the M-channel audio signal may contribute, via the downmix signal, to the same channel of the decorrelation input signal in both of these coding formats. It will be appreciated that in the present example embodiment, the first channel of the M-channel audio signal may for example contribute, via the downmix signal, to multiple channels of the decorrelation input signal in a given coding format.

In the present example embodiment, if the indicated coding format switches between the two coding formats, then at least a portion of the first fixed channel of the decorrelation input signal remains during the switch. This may allow for a smoother and/or less abrupt transition between the coding formats, as perceived by a listener during playback of the M-channel audio signal as reconstructed. In particular, the inventors have realized that since the decorrelated signal may for example be generated based on a section of the downmix signal corresponding to several time frames, during which a switch between the coding formats may occur in the downmix signal, audible artifacts may potentially be generated in the decorrelated signal as a result of switching between coding formats. Even if the wet and dry upmix coefficients are interpolated in response to a switch between the coding formats, artifacts generated in the decorrelated signal may still persist in the M-channel audio signal as reconstructed. Providing a decorrelation input signal in accordance with the present example embodiment allows for suppressing such artifacts in the decorrelated signal that are caused by switching between the coding formats, and may improve playback quality of the M-channel audio signal as reconstructed.

In an example embodiment, the pre-decorrelation coefficients may be determined such that, additionally, a second channel of the M-channel audio signal contributes, via the downmix signal, to a second fixed channel of the decorrelation input signal in at least two of the coding formats. This is to say, the second channel of the M-channel audio signal contributes, via the downmix signal, to the same channel of the decorrelation input signal in both these coding formats. In the present example embodiment, if the indicated coding format switches between the two coding formats, then at least a portion of the second fixed decorrelation input signal remains during the switch. As such, only a single decorrelator feed is affected by a transition between the coding formats. This may allow for a smoother and/or less abrupt transition between the coding formats, as perceived by a listener during playback of the M-channel audio signal as reconstructed.

The first and second channels of the M-channel audio signal may for example be distinct from each other. The first and second fixed channels of the decorrelation input signal may for example be distinct from each other.

In an example embodiment, the received signaling may indicate a selected one of at least three coding formats, and the pre-decorrelation coefficients may be determined such that the first channel of the M-channel audio signal contributes, via the downmix signal to the first fixed channel of the decorrelation input signal in at least three of the coding formats. This is to say, the first channel of the M-channel audio signal contributes, via the downmix signal, to the same channel of the decorrelation input signal in these three coding formats. In the present example embodiment, if the indicated coding format changes between any of the three coding formats, then at least a portion of the first fixed channel of the decorrelation input signal remains during the switch, which allows for a smoother and/or less abrupt transition between the coding formats, as perceived by a listener during playback of the M-channel audio signal as reconstructed.

In an example embodiment, the pre-decorrelation coefficients may be determined such that a pair of channels of the M-channel audio signal contributes, via the downmix signal, to a third fixed channel of the decorrelation input signal in at least two of the coding formats. This is to say, the pair of channels of the M-channel audio signal contributes, via the downmix signal, to the same channel of the decorrelation input signal in both these coding formats. In the present example embodiment, if the indicated coding format switches between the two coding formats, then at least a portion of the third fixed channel of the decorrelation input signal remains during the switch, which allows for a smoother and/or less abrupt transition between the coding formats, as perceived by a listener during playback of the M-channel audio signal as reconstructed.

The pair of channels may for example be distinct from the first and second channels of the M-channel audio signal. The third fixed channel of the decorrelation input signal may for example be distinct from the first and second fixed channels of the decorrelation input signal.

In an example embodiment, the audio decoding method may further comprise: in response to detecting a switch of the indicated coding format from a first coding format to a second coding format, performing a gradual transition from pre-decorrelation coefficient values associated with the first coding format to pre-decorrelation coefficient values associated with the second coding format. Employing a gradual transition between pre-decorrelation coefficients during switching between coding formats allows for a smoother and/or less abrupt transition between the coding formats, as perceived by a listener during playback of the M-channel audio signal as reconstructed. In particular, the inventors have realized that since the decorrelated signal may for example be generated based on a section of the downmix signal corresponding to several time frames, during which a switch between the coding formats may occur in the downmix signal, audible artifacts may potentially be generated in the decorrelated signal as a result of switching between coding formats. Even if the wet and dry upmix coefficients are interpolated in response to a switch between the coding formats, artifacts generated in the decorrelated signal may still persist in the M-channel audio signal as reconstructed. Providing a decorrelation input signal in accordance with the present example embodiment allows for suppressing such artifacts in the decorrelated signal that are caused by switching between the coding formats, and may improve playback quality of the M-channel audio signal as reconstructed.

The gradual transition may for example be performed via linear or continuous interpolation. The gradual transition may for example be performed via interpolation with a limited rate of change.

In an example embodiment, the audio decoding method may further comprise: in response to detecting a switch of the indicated coding format from a first coding format to a second coding format, performing interpolation from wet and dry upmix coefficient values, including the zero-valued coefficients, associated with the first coding format to wet and dry upmix coefficient values, again including the zero-valued coefficients, associated with the second coding format. It is recalled that the downmix channels correspond to different combinations of channels from the M-channel audio signal originally encoded, so that an upmix coefficient which is zero-valued in the first coding format need not be zero-valued in the second coding format too, and vice versa. Preferably, the interpolation acts upon the upmix coefficients rather than a compact representation of the coefficients, e.g. the representation discussed below.

Linear or continuous interpolation between the upmix coefficient values may for example be employed for providing a smoother transition between the coding formats, as perceived by a listener during playback of the M-channel audio signal as reconstructed.

Steep interpolation, in which new upmix coefficient values replace old upmix coefficient values at a certain point in time associated with the switch between the coding formats, may for example allow for increased fidelity of the M-channel audio signal as reconstructed, e.g. in cases where the audio content of the M-channel audio signal changes quickly and where the coding format is switched on an encoder side, in response to these changes, for increasing fidelity of the M-channel audio signal as reconstructed.

In an example embodiment, the audio decoding method may further comprise receiving signaling indicating one of a plurality of interpolation schemes to be employed for the interpolation of wet and dry upmix parameters within one coding format (i.e., when new values are assigned to the upmix coefficients in a period of time where no change of coding format occurs), and employing the indicated interpolation scheme. The signaling indicating one of a plurality of interpolation schemes may for example be received together with the downmix signal and/or the upmix parameters. Preferably, the interpolation scheme indicated by the signaling may further be employed to transition between coding formats.

On an encoder side, where the original M-channel audio signal is available, interpolation schemes may for example be selected which are particularly suitable for the actual audio content of the M-channel audio signal. For example, linear or continuous interpolation may be employed where smooth switching is important for the overall impression of the M-channel audio signal as reconstructed, while steep interpolation, i.e. in which new upmix coefficient values replace old upmix coefficient values at a certain point in time associated with the transition between the coding formats, may be employed when fast switching is important for the overall impression of the M-channel audio signal as reconstructed.

In an example embodiment, the at least two coding formats may include a first coding format and a second coding format. There is a gain controlling a contribution, in each coding format, from a channel of the M-channel audio signal to one of the linear combinations to which the channels of the downmix signal correspond. In the present example embodiment, a gain in the first coding format may coincide with a gain in the second coding format that controls a contribution from the same channel of the M-channel audio signal.

Employing the same gains in the first and second coding formats may for example increase the similarity between the combined audio content of the channels of the downmix signal in the first coding format and the combined audio content of the channels of the downmix signal in the second coding format. Because the channels of the downmix signal are used to reconstruct the M-channel downmix signal, this may contribute to smoother transitions between these two coding formats, as perceived by a listener.

Employing the same gains in the first and second coding formats may for example allow for the audio content of the first and second channels, respectively, of the downmix signal in the first coding format to be more similar to the audio content of the first and second channels, respectively, of the downmix signal in the second coding format. This may contribute to smoother transitions between these two coding formats, as perceived by a listener.

In the present example embodiment, different gains may for example be employed for different channels of the M-channel audio signal. In a first example, all the gains in the first and second coding formats may have the value 1. In the first example, the first and second channels of the downmix signal may correspond to non-weighted sums of the first and second groups, respectively, in both the first and the second coding format. In a second example, at least some of the gains may have different values than 1. In the second example, the first and second channels of the downmix signal may correspond to weighted sums of the first and second groups, respectively.

In an example embodiment, the M-channel audio signal may comprise three channels representing different horizontal directions in a playback environment for the M-channel audio signal, and two channels representing directions vertically separated from those of the three channels in the playback environment. In other words, the M-channel audio signal may comprise three channels intended for playback by audio sources located at substantially the same height as a listener (or a listener's ear) and/or propagating substantially horizontally, and two channels intended for playback by audio sources located at other heights and/or propagating (substantially) non-horizontally. The two channels may for example represent elevated directions.

In an example embodiment, in a first coding format, the second group of channels may comprise the two channels representing directions vertically separated from those of the three channels in the playback environment. Having both these two channels in the second group, and employing the same channel of the downmix signal to represent both these two channels, may for example improve fidelity of the M-channel audio signal as reconstructed in cases where a vertical dimension in the playback environment is important for the overall impression of the M-channel audio signal.

In an example embodiment, in a first coding format, the first group of one or more channels may comprise the three channels representing different horizontal directions in a playback environment of the M-channel audio signal, and the second group of one or more channels may comprise the two channels representing directions vertically separated from those of the three channels in the playback environment. In the present example embodiment, the first coding format allows the first channel of the downmix signal to represent the three channels and the second channel of the downmix signal to represent the two channels, which may for example improve fidelity of the M-channel audio signal as reconstructed in cases where a vertical dimension in the playback environment is important for the overall impression of the M-channel audio signal.

In an example embodiment, in a second coding format, each of the first and second groups may comprise one of the two channels representing directions vertically separated from those of the three channels in a playback environment of the M-channel audio signal. Having these two channels in different groups, and employing the different channels of the downmix signal to represent these two channels, may for example improve fidelity of the M-channel audio signal as reconstructed in cases where a vertical dimension in the playback environment is not as important for the overall impression of the M-channel audio signal.

In an example embodiment, in a coding format, referred to herein as a particular coding format, the first group of one or more channels may consist of N channels, where $N \geq 3$. In the present example embodiment, in response to the indicated coding format being the particular coding format: the pre-decorrelation coefficients may be determined such that N−1 channels of the decorrelated signal are generated based on the first channel of the downmix signal; and the dry and wet upmix coefficients may be determined such that the first group of one or more channels is reconstructed as a linear mapping of the first channel of the downmix signal and the N−1 channels of the decorrelated signal, wherein a subset of the dry upmix coefficients is applied to the first channel of the downmix signal and a subset of the wet upmix coefficients is applied to the N−1 channels of the decorrelated signal.

The pre-decorrelation coefficients may for example be determined such that N−1 channels of the decorrelation input signal coincide with the first channel of the downmix signal. The N−1 channels of the decorrelated signal may for example be generated by processing these N−1 channels of the decorrelation input signal.

By the first group of one or more channels being reconstructed as a linear mapping of the first channel of the downmix signal and the N−1 channels of the decorrelated signal is meant that a reconstructed version of the first group of one or more channels is obtained by applying a linear transformation to the first channel of the downmix signal and the N−1 channels of the decorrelated signal. This linear transformation takes N channels as input and provides N channels as output, where the subset of the dry upmix coefficients and the subset of the wet upmix coefficients together consist of coefficients defining the quantitative properties of this linear transformation.

In an example embodiment, the received upmix parameters may include upmix parameters of a first type, referred to herein as wet upmix parameters, and upmix parameters of a second type, referred to herein as dry upmix parameters. In the present example embodiment, determining the sets of wet and dry upmix coefficients, in the particular coding format, may comprise: determining, based on the dry upmix parameters, the subset of the dry upmix coefficients; populating an intermediate matrix having more elements than the number of received wet upmix parameters, based on the received wet upmix parameters and knowing that the intermediate matrix belongs to a predefined matrix class; and obtaining the subset of the wet upmix coefficients by multiplying the intermediate matrix by a predefined matrix, wherein the subset of the wet upmix coefficients corresponds to the matrix resulting from the multiplication and includes more coefficients than the number of elements in the intermediate matrix.

In the present example embodiment, the number of wet upmix coefficients in the subset of wet upmix coefficients is larger than the number of received wet upmix parameters. By exploiting knowledge of the predefined matrix and the predefined matrix class to obtain the subset of wet upmix coefficients from the received wet upmix parameters, the amount of information needed for parametric reconstruction of the first group of one or more channels may be reduced, allowing for a reduction of the amount of metadata transmitted together with the downmix signal from an encoder side. By reducing the amount of data needed for parametric reconstruction, the required bandwidth for transmission of a parametric representation of the M-channel audio signal, and/or the required memory size for storing such a representation may be reduced.

The predefined matrix class may be associated with known properties of at least some matrix elements which are valid for all matrices in the class, such as certain relationships between some of the matrix elements, or some matrix elements being zero. Knowledge of these properties allows for populating the intermediate matrix based on fewer wet upmix parameters than the full number of matrix elements in the intermediate matrix. The decoder side has knowledge at least of the properties of, and relationships between, the elements it needs to compute all matrix elements on the basis of the fewer wet upmix parameters.

How to determine and employ the predefined matrix and the predefined matrix class is described in more detail on page 16, line 15 to page 20, line 2 in U.S. provisional patent application No. 61/974,544; first named inventor: Lars Villemoes; filing date: 3 Apr. 2014. See in particular equation (9) therein for examples of the predefined matrix.

In an example embodiment, the received upmix parameters may include $N(N-1)/2$ wet upmix parameters. In the present example embodiment, populating the intermediate matrix may include obtaining values for $(N-1)^2$ matrix elements based on the received $N(N-1)/2$ wet upmix parameters and knowing that the intermediate matrix belongs to the predefined matrix class. This may include inserting the values of the wet upmix parameters immediately as matrix elements, or processing the wet upmix parameters in a suitable manner for deriving values for the matrix elements. In the present example embodiment, the pre-defined matrix may include $N(N-1)$ elements, and the subset of the wet upmix coefficients may include $N(N-1)$ coefficients. For example, the received upmix parameters may include no more than $N(N-1)/2$ independently assignable wet upmix parameters and/or the number of wet upmix parameters may be no more than half the number of wet upmix coefficients in the subset of wet upmix coefficients.

In an example embodiment, the received upmix parameters may include (N−1) dry upmix parameters. In the present example embodiment, the subset of the dry upmix coefficients may include N coefficients, and the subset of the dry upmix coefficients may be determined based on the received (N−1) dry upmix parameters and based on a predefined relation between the coefficients in the subset of the dry upmix coefficients. For example, the received upmix parameters may include no more than (N−1) independently assignable dry upmix parameters.

In an example embodiment, the predefined matrix class may be one of: lower or upper triangular matrices, wherein known properties of all matrices in the class include predefined matrix elements being zero; symmetric matrices, wherein known properties of all matrices in the class include predefined matrix elements (on either side of the main diagonal) being equal; and products of an orthogonal matrix and a diagonal matrix, wherein known properties of all matrices in the class include known relations between predefined matrix elements. In other words, the predefined matrix class may be the class of lower triangular matrices, the class of upper triangular matrices, the class of symmetric matrices or the class of products of an orthogonal matrix and a diagonal matrix. A common property of each of the above classes is that its dimensionality is less than the full number of matrix elements.

In an example embodiment, the predefined matrix and/or the predefined matrix class may be associated with the indicated coding format, e.g. allowing the decoding method to adjust the determination of the set of wet upmix coefficients accordingly.

According to example embodiments, there is provided an audio decoding method comprising: receiving signaling indicating one of at least two predefined channel configurations; in response to detecting the received signaling indicating a first predefined channel configuration, performing any of the audio decoding methods of the first aspect. The audio decoding method may comprise, in response to detecting the received signaling indicating a second predefined channel configuration: receiving a two-channel downmix signal and associated upmix parameters; performing parametric reconstruction of a first three-channel audio signal based on a first channel of the downmix signal and at least some of the upmix parameters; and performing parametric reconstruction of a second three-channel audio signal based on a second channel of the downmix signal and at least some of the upmix parameters.

The first predefined channel configuration may correspond to the M-channel audio signal being represented by the received two-channel downmix signal and the associated upmix parameters. The second predefined channel configuration may correspond the first and second three-channel audio signals being represented by the first and second channels of the received downmix signal, respectively, and by the associated upmix parameters.

The ability to receive signaling indicating one of at least two predefined channel configurations, and to perform parametric reconstruction based on the indicated channel configuration, may allow for a common format to be employed for a computer-readable medium carrying a parametric representation of either the M-channel audio signal or the two three-channel audio signals, from an encoder side to a decoder side.

According to example embodiments, there is provided an audio decoding system comprising a decoding section configured to reconstruct an M-channel audio signal based on a two-channel downmix signal and associated upmix parameters, where M≥4. The audio decoding system comprises a control section configured to receive signaling indicating a selected one of at least two coding formats of the M-channel audio signal. The coding formats correspond to respective different partitions of the channels of the M-channel audio signal into respective first and second groups of one or more channels. In the indicated coding format, a first channel of the downmix signal corresponds to a linear combination of the first group of one or more channels of the M-channel audio signal, and a second channel of the downmix signal corresponds to a linear combination of the second group of one or more of channels of the M-channel audio signal. The decoding section comprises: a pre-decorrelation section configured to determine a set of pre-decorrelation coefficients based on the indicated coding format, and to compute a decorrelation input signal as a linear mapping of the downmix signal, wherein the set of pre-decorrelation coefficients is applied to the downmix signal; and a decorrelating section configured to generate a decorrelated signal based on the decorrelation input signal. The decoding section comprises a mixing section configured to: determine sets of wet and dry upmix coefficients based on the received upmix parameters and the indicated coding format; compute a dry upmix signal as a linear mapping of the downmix signal, wherein the set of dry upmix coefficients is applied to the downmix signal; compute a wet upmix signal as a linear mapping of the decorrelated signal, wherein the set of wet upmix coefficients is applied to the decorrelated signal; and combine the dry and wet upmix signals to obtain a multidimensional reconstructed signal corresponding to the M-channel audio signal to be reconstructed.

In an example embodiment, the audio decoding system may further comprise an additional decoding section configured to reconstruct an additional M-channel audio signal based on an additional two-channel downmix signal and associated additional upmix parameters. The control section may be configured to receive signaling indicating a selected one of at least two coding formats of the additional M-channel audio signal. The coding formats of the additional M-channel audio signal may correspond to respective different partitions of the channels of the additional M-channel audio signal into respective first and second groups of one or more channels. In the indicated coding format of the additional M-channel audio signal, a first channel of the additional downmix signal may correspond to a linear combination of the first group of one or more channels of the additional M-channel audio signal, and a second channel of the additional downmix signal may correspond to a linear combination of the second group of one or more channels of the additional M-channel audio signal. The additional decoding section may comprise: an additional pre-decorrelation section configured to determine an additional set of pre-decorrelation coefficients based on the indicated coding format of the additional M-channel audio signal, and to compute an additional decorrelation input signal as a linear mapping of the additional downmix signal, wherein the additional set of pre-decorrelation coefficients is applied to the additional downmix signal; and an additional decorrelating section configured to generate an additional decorrelated signal based on the additional decorrelation input signal. The additional decoding section may further comprise an additional mixing section configured to: determine additional sets of wet and dry upmix coefficients based on the received additional upmix parameters and the indicated coding format of the additional M-channel audio signal; compute an additional dry upmix signal as a linear mapping of the additional downmix signal, wherein the additional set of dry upmix coefficients is applied to the additional downmix signal; compute an additional wet upmix signal as a linear mapping of the additional decorrelated signal, wherein the additional set of wet upmix coefficients is applied to the additional decorrelated signal; and combine the additional dry and wet upmix signals to obtain an additional multidimensional reconstructed signal corresponding to the additional M-channel audio signal to be reconstructed.

In the present example embodiment, the additional decoding section, the additional pre-decorrelation section, the additional decorrelating section and the additional mixing section may for example be operable independently of the decoding section, the pre-decorrelation section, the decorrelating section and the mixing section.

In the present example embodiment, the additional decoding section, the additional pre-decorrelation section, the additional decorrelating section and the additional mixing section may for example be functionally equivalent to (or analogously configured as) the decoding section, the pre-decorrelation section, the decorrelating section and the mixing section, respectively. Alternatively, at least one of the additional decoding section, the additional pre-decorrelation section, and the additional decorrelating section and the additional mixing section may for example be configured to perform at least one different type of interpolation than performed by the corresponding section of the decoding section, the pre-decorrelation section, the decorrelating section and the mixing section.

For example, the received signaling may indicate different coding formats for the M-channel audio signal and the additional M-channel audio signal. Alternatively, the coding formats of the two M-channel audio signals may for example always coincide, and the received signaling may indicate a selected one of at least two common coding formats for the two M-channel audio signals.

Interpolation schemes employed for gradual transitions between pre-decorrelation coefficients, in response to switching between coding formats of the M-channel audio signal, may coincide with, or may be different than interpolation schemes employed for gradual transitions between additional pre-decorrelation coefficients, in response to switching between coding formats of the additional M-channel audio signal.

Similarly, interpolation schemes employed for interpolation of values of the wet and dry upmix coefficients, in response to switching between coding formats of the M-channel audio signal, may coincide with, or may be different than interpolation schemes employed for interpolation of values of the additional wet and dry upmix coefficients, in response to switching between coding formats of the additional M-channel audio signal.

In an example embodiment, the audio decoding system may further comprise a demultiplexer configured to extract, from a bitstream, the downmix signal, the upmix parameters associated with the downmix signal, and a discretely coded audio channel. The decoding system may further comprise a single-channel decoding section operable to decode the discretely coded audio channel. The discretely coded audio channel may for example be encoded in the bitstream using a perceptual audio codec such as Dolby Digital, MPEG AAC, or developments thereof, and the single-channel decoding section may for example comprise a core decoder for decoding the discretely coded audio channel. The single-channel decoding section may for example be operable to decode the discretely coded audio channel independently of the decoding section.

According to example embodiments, there is provided a computer program product comprising a computer-readable medium with instructions for performing any of the methods of the first aspect.

II. Overview—Encoder Side

According to a second aspect, example embodiments propose audio encoding systems as well as audio encoding methods and associated computer program products. The proposed encoding systems, methods and computer program products, according to the second aspect, may generally share the same features and advantages. Moreover, advantages presented above for features of decoding systems, methods and computer program products, according to the first aspect, may generally be valid for the corresponding features of encoding systems, methods and computer program products according to the second aspect.

According to example embodiments, there is provided an audio encoding method comprising: receiving an M-channel audio signal, for which M≥4. The audio encoding method comprises repeatedly selecting one of at least two coding formats on the basis of any suitable selection criterion, e.g. signal properties, system load, user preference, network conditions. The selection may be repeated once for each time frame of the audio signal or once for every $n^{th}$ time frame, possibly leading to selection of a different format than the one initially chosen; alternatively, the selection may be event-driven. The coding formats correspond to respective different partitions of the channels of the M-channel audio signal into respective first and second groups of one or more channels. In each of the coding formats, a two-channel downmix signal includes a first channel formed as a linear combination of the first group of one or more channels of the M-channel audio signal, and a second channel formed as a linear combination of the second group of one or more channels of the M-channel audio signal. For the selected coding format, the downmix channel is computed on the basis of the M-channel audio signal. Once computed, the downmix signal of the currently selected coding format is output, as is signaling indicating the currently selected coding format and side information enabling parametric reconstruction of the M-channel audio signal. If the selection results in a change from a first selected coding format to a second, distinct selected coding format, a transition may be initiated, whereby a cross fade of the downmix signal according to the first selected coding format and the downmix signal according to the second selected coding format is output. In this context, a cross fade may be a linear or non-linear time interpolation of two signals. As an example, $$y(t)=tx_1(t)+(1-t)x_2(t), t\in[0,1]$$

provides a cross fade y from function $x_2$ to function $x_1$ linearly over time, wherein $x_1$, $x_2$ may be vector-valued functions of time representing the downmix signals according to the respective coding formats. For simplicity of notation, the time interval, over which the cross fade is carried out, has been rescaled to [0, 1], wherein t=0 represents the onset of cross fade and t=1 represents the point in time when the cross fade has been completed.

The location of the points t=0 and t=1 in physical units may be important to the perceived output quality of the reconstructed audio. As a possible guideline for locating the cross fade, the onset may occur as early as possible after the need for a different format has been determined, and/or the cross fade may complete in the shortest possible time that is perceptually unnoticeable. As such, for implementations where the selection of a coding format is repeated every frame, some example embodiments provide that the cross fade starts (t=0) at the beginning of the frame, and has its endpoint (t=1) as close as possible but distant enough that an average listener is unable to notice artifacts or degradations due to a transition between two reconstructions of a common M-channel audio signal (with typical content) based on two distinct coding formats. In one example embodiment, the downmix signal output by the audio encoding method is segmented into time frames and a cross fade may occupy one frame. In another example embodiment, the downmix signal output by the audio encoding method is segmented into overlapping time frames and the duration of a cross fade corresponds to the stride from one time frame to the next one.

In example embodiments, the signaling indicating the currently selected coding format may be encoded on a frame-by-frame basis. Alternatively, the signaling may be time-differential in the sense that such signaling can be omitted in one or more consecutive frames if there is no change in the selected coding format. On the decoder side, such a sequence of frames may be interpreted to mean that the most recently signaled coding format remains selected.

Depending on the audio content of the M-channel audio signal, different partitions of the channels of the M-channel audio signal into first and second groups, represented by the respective channels of the downmix signal, may be suitable in order to capture and efficiently encode the M-channel audio signal, and to preserve fidelity when this signal is reconstructed from the downmix signal and associated upmix parameters. The fidelity of the M-channel audio signal as reconstructed may therefore be increased by selecting an appropriate coding format, namely the best suited from a number of predefined coding formats.

In an example embodiment, the side information includes dry and wet upmix coefficients, in the same sense as these terms have been used above in this disclosure. Unless for specific implementation reasons, it is generally sufficient to compute the side information (in particular, the dry and wet upmix coefficients) for the currently selected coding format. In particular, the set of dry upmix coefficients (which may be represented as a matrix of dimensions M×2) may define a linear mapping of the respective downmix signal approximating the M-channel audio signal. The set of wet upmix coefficients (which may be represented as a matrix of dimensions M×P, where P, the number of decorrelators, may be set to P=M−2) defines a linear mapping of the decorrelated signal such that a covariance of the signal obtained by said linear mapping of the decorrelated signal supplements a covariance of the M-channel audio signal as approximated by the linear mapping of the downmix signal of the selected coding format. The mapping of the decorrelated signal which the set of wet upmix coefficients defines will supplement the covariance of the M-channel audio signal (as approximated) in the sense that the covariance of the sum the M-channel audio signal and the mapping of the decorrelated signal is typically closer to the covariance of the received M-channel audio signal. An effect of adding the supplementary covariance may be improved fidelity of a reconstructed signal on the decoder side.

The linear mapping of the downmix signal provides an approximation of the M-channel audio signal. When reconstructing the M-channel audio signal on a decoder side, the decorrelated signal is employed to increase the dimensionality of the audio content of the downmix signal, and the signal obtained by the linear mapping of the decorrelated signal is combined with the signal obtained by the linear mapping of the downmix signal to improve fidelity of the approximation of the M channel audio signal. Since the decorrelated signal is determined based on at least one channel of the downmix signal, and does not comprise any audio content from the M-channel audio signal that is not already available in the downmix signal, the difference between the covariance of the M-channel audio signal as received and the covariance of the M-channel audio signal as approximated by the linear mapping of the downmix signal, may be indicative not only of a fidelity of the M-channel audio signal as approximated by the linear mapping of the downmix signal, but also of a fidelity of the M-channel audio signal as reconstructed using both the downmix signal and the decorrelated signal. In particular, a reduced difference between the covariance of the M-channel audio signal as received and the covariance of the M-channel audio signal as approximated by the linear mapping of the downmix signal may be indicative of improved fidelity of the M-channel audio signal as reconstructed. The mapping of the decorrelated signal which the set of wet upmix coefficients defines supplements the covariance of the M-channel audio signal (obtained from the downmix signal) in the sense that the covariance of the sum the M-channel audio signal and the mapping of the decorrelated signal is closer to the covariance of the received M-channel audio signal. Selecting one of the coding formats based on the respective computed differences therefore allows for improving fidelity of the M-channel audio signal as reconstructed.

It will be appreciated that the coding format may be selected e.g. directly based on the computed differences, or based on coefficients and/or values determined based on the computed differences.

It will also be appreciated that the coding format may be selected based on e.g. the respective computed dry upmix parameters in addition to the respective computed differences. The set of dry upmix coefficients may for example be determined via a minimum mean square error approximation under the assumption that only the downmix signal is available for the reconstruction, i.e. under the assumption that the decorrelated signal is not employed for the reconstruction.

The computed differences may for example be differences between a covariance matrix of the M-channel audio signal as received and covariance matrices of the M-channel audio signal as approximated by the respective linear mappings of the downmix signal of the different coding formats. Selecting one of the coding formats may for example include computing matrix norms for the respective differences between covariance matrices, and selecting one of the coding formats based on the computed matrix norms, e.g. selecting a coding format associated with a minimal one of the computed matrix norms.

The decorrelated signal may for example include at least one channel and at most M−2 channels.

By the set of dry upmix coefficients defining a linear mapping of the downmix signal approximating the M-channel downmix signal is meant that an approximation of the M-channel downmix signal is obtained by applying a linear transformation to the downmix signal. This linear transformation takes the two channels of the downmix signal as input and provides M channels as output, and the dry upmix coefficients are coefficients defining the quantitative properties of this linear transformation.

Similarly, the wet upmix parameters define the quantitative properties of a linear transformation taking the channel(s) of the decorrelated signal as input, and providing M channels as output.

In an example embodiment, the wet upmix parameters may be determined such that a covariance of the signal obtained by the linear mapping (which the wet upmix parameters define) of the decorrelated signal approximates a difference between the covariance of the M-channel audio signal as received and a covariance of the M-channel audio signal as approximated by the linear mapping of the downmix signal of the selected coding format. Put differently, the covariance of a sum of a first linear mapping (defined by the dry upmix parameters) of the downmix signal and a second linear mapping (defined by the wet upmix parameters, determined in accordance with this example embodiment) of the decorrelated signal will be close to the covariance of the M-channel audio signal that constitutes the input to the audio encoding method discussed hereinabove. Determining the wet upmix coefficients in accordance with the present example embodiment may improve fidelity of the M-channel audio signal as reconstructed.

Alternatively, the wet upmix parameters may be determined such that a covariance of the signal obtained by the linear mapping of the decorrelated signal approximates a portion of a difference between the covariance of the M-channel audio signal as received and a covariance of the M-channel audio signal as approximated by the linear mapping of the downmix signal of the selected coding format. If, for example, a limited number of decorrelators are available on a decoder side, it may not be possible to fully reinstate the covaraince of the M-channel audio signal as received. In such an example, wet upmix parameters suitable for partial reconstruction of the covariance of the M-channel audio signal, employing a reduced number of decorrelators, may be determined on the encoder side.

In an example embodiment, the audio encoding method may further comprise, for each of the at least two coding formats: determining a set of wet upmix coefficients which together with the dry upmix coefficients (of that coding format) allows for parametric reconstruction of the M-channel audio signal from the downmix signal (of that coding format) and from a decorrelated signal determined based on the downmix signal (of that format), wherein the set of wet upmix coefficients defines a linear mapping of the decorrelated signal such that a covariance of a signal obtained by the linear mapping of the decorrelated signal approximates a difference between the covariance of the M-channel audio signal as received and a covariance of the M-channel audio signal as approximated by the linear mapping of the downmix signal (of that format). In the present example embodiment, the selected coding format may be selected based on values of the respective determined sets of wet upmix coefficients.

An indication of the fidelity of the M-channel audio signal as reconstructed may for example be obtained based on the determined wet upmix coefficents. The selection of a coding format may for example be based on weighted or non-weighted sums of the determined wet upmix coefficients, on weighted or non-weighted sums of magnitudes of the determined wet upmix coefficients, and/or on weighted or non-weighted sums of squares of the determined wet upmix coeffiecients, e.g. also based on corresponding sums of the respective computed dry upmix coefficients.

The wet upmix parameters may for example be computed for a plurality of frequency bands of the M-channel signal, and the selection of a coding format may for example be based on values of the respective determined sets of wet upmix coefficients in the respective frequency bands.

In an example embodiment, a transition between a first and a second coding format includes outputting discrete values of the dry and wet upmix coefficients of the first coding format in one time frame and of the second coding format in a subsequent time frame. Functionalities in a decoder eventually reconstructing the M-channel signal may include interpolation of the upmix coefficients between the output discrete values. By virtue of such decoder-side functionalities, a cross fade from the first to the second coding format will effectively result. Like the cross-fading applied to the downmix signal, as described above, such cross-fading may lead to a less perceptible transition between the coding formats when the M-channel audio signal is reconstructed.

It is understood that the coefficients employed to compute the downmix signal based on the M-channel audio signal may be interpolated, i.e., from values associated with a frame where the downmix signal is computed according to a first coding format, to values associated with a frame where the downmix signal is computed according to the second coding format. At least if downmixing takes place in the time domain, a downmix cross fade resulting from coefficient interpolation of the type outlined will be equivalent to a cross fade resulting from interpolation performed directly on the respective downmix signals. It is recalled that the values of the coefficients employed for computing the downmix signal typically are not signal-dependent but may be predefined for each of the available coding formats.

Returning to the cross-fading of the downmix signal and the upmix coefficients, it is deemed advantageous to ensure synchronicity between the two cross-fades. Preferably, the respective transitions periods for the downmix signal and the upmix coefficients may coincide. In particular, the entities responsible for the respective cross-fades may be controlled by a common stream of control data. Such control data may include starting points and ending points of the cross fade, and optionally a cross fade waveform, such as linear, non-linear etc. In the case of the upmix coefficients, the cross fade waveform may be given by a predetermined interpolation rule that governs the behavior of a decoding device; the starting and ending points of the cross fades may however be controlled implicitly by the positions at which the discrete values of the upmix coefficients are defined and/or output. The similarity in time dependence of the two cross-fading processes ensures a good match between the downmix signal and the parameters provided for its reconstruction, which may lead to a reduction in artifacts on the decoder side.

In an example embodiment, the selection of a coding format is based on comparing the difference, in terms of covariance, of the M-channel signal as received and the M-channel signal as reconstructed on the basis of the downmix signal. In particular, the reconstruction may be equal to a linear mapping of the downmix signal as defined by the dry upmix coefficients only, that is, without a contribution from a signal that has been determined using decorrelation (e.g., to increase the dimensionality of the audio content of the downmix signal). In particular, no contribution of the linear mapping defined by any set of wet upmix coefficients is to be considered in the comparison. Put differently, the comparison is made as if no decorrelated signal had been available. This basis for the selection may favor a coding format that currently allows for more faithful reproduction. Optionally, after this comparison has been performed and a decision has been made as to the selection of a coding format, a set of wet upmix coefficients is determined. An advantage associated with this process is that there is no duplicate determination of wet upmix coefficients for a given section of the received M-channel audio signal.

In a variation to the example embodiment described in the preceding paragraph, the dry and wet upmix coefficients are computed for all of the coding formats and a quantitative measure of the wet upmix coefficients is used as basis for the selection of a coding format. Indeed, a quantity computed on the basis of the determined wet upmix coefficents may provide an (inverse) indication of the fidelity of the M-channel audio signal as reconstructed. The selection of a coding format may for example be based on weighted or non-weighted sums of the determined wet upmix coefficients, on weighted or non-weighted sums of magnitudes of the determined wet upmix coefficients, and/or on weighted or non-weighted sums of squares of the determined wet upmix coefficients. Each of these options may be combined with corresponding sums of the respective computed dry upmix coefficients. The wet upmix parameters may for example be computed for a plurality of frequency bands of the M-channel signal, and the selection of a coding format may for example be based on values of the respective determined sets of wet upmix coefficients in the respective frequency bands.

In an example embodiment, the audio encoding method may further comprise: for each of the at least two coding formats, computing a sum of squares of the corresponding wet upmix coefficients and a sum of squares of the corresponding dry upmix coefficients. In the present example embodiment, the selected coding format may be selected based on the computed sums of squares. The inventors have realized that the computed sums of squares may provide a particularly good indication of the loss of fidelity, as perceived by a listener, occurring when the M-channel audio signal is reconstructed based on the mixture of wet and dry contributions.

For example, a ratio may be formed for each coding format, based on the computed sums of squares for the respective coding format, and the selected coding format may be associated with a minimal or maximal one of the formed ratios. Forming a ratio may for example include dividing, on the one hand, a sum of squares of wet upmix coefficients by, on the other hand, a sum of a sum of squares of dry upmix coefficients and a sum of squares of wet upmix coefficients. Alternatively, the ratio may be formed by dividing a sum of squares of wet upmix coefficients by a sum of squares of dry upmix coefficients.

In an example embodiment, the method provides encoding of an M-channel audio signal and at least one associated ($M_2$-channel) audio signal. The audio signals may be associated in the sense that they describe a common audio scene, e.g., by having been recorded contemporaneously or generated in a common authoring process. The audio signals need not be encoded by way of a common downmix signal, but may be encoded in separate processes. In such setup, the selection of one of the coding formats additionally takes into account data relating to said at least one further audio channel, and the coding format thus selected is to be used for encoding both the M-channel audio signal and the associated ($M_2$-channel) audio signal.

In an example embodiment, the downmix signal output by the audio encoding method may be segmented into time frames, the selection of a coding format may be performed once per frame, and the selected coding format may be maintained for at least a predefined number of time frames before a different coding format is selected. The selection of a coding format for a frame may be performed by any of the methods outlined above, e.g., by considering differences between covariances, considering values of the wet upmix coefficients for the available coding formats, and the like. By maintaining the selected coding format for a minimal number of time frames, repeated jumps back and forth between coding formats may for example be avoided. The present example embodiment may for example improve play-back quality, as perceived by a listener, of the M-channel audio signal as reconstructed.

The minimal number of time frames may for example be 10.

The received M-channel audio signal may for example be buffered for the minimal number of time frames, and the selection of a coding format may for example be performed based on a majority decision over a moving window comprising a number of time frames chosen in view of said minimal number of frames that a selected coding format is to be maintained. An implementation of such stabilizing functionality may include one of the various smoothing filters, in particular finite impulse response smoothing filters that are known in digital signal processing. Alternative to this approach, the coding format can be switched to a new coding format when the new coding format is found to have been selected for said minimal number of frames in sequence. To enforce this criterion, a moving time window with the minimal number of consecutive frames may be applied to past coding format selections, e.g. for the buffered frames. If, after a sequence of frames of a first coding format, a second coding format has remained selected for each frame within the moving window, the transition to the second coding format is confirmed and takes effect from the beginning of the moving window onwards. An implementation of the above stabilizing functionality may include a state machine.

In an example embodiment, there is provided a compact representation of the dry and wet upmix parameters, which inter alia includes generating an intermediate matrix which by virtue of belonging to a predefined matrix class is uniquely determined by a smaller number of parameters than the elements in the matrix. Aspects of this compact representation have been described in earlier sections of this disclosure, and with particular reference to U.S. Provisional Patent Application No. 61/974,544, first named inventor: Lars Villemoes; filing date: 3 Apr. 2014.

In an example embodiment, in the selected coding format, the first group of one or more channels of the M-channel audio signal may consist of N channels, where $N \geq 3$. The first group of one or more channels may be reconstructable from the first channel of the downmix signal and $N-1$ channels of the decorrelated signal by applying at least some of the wet and dry upmix coefficients.

In the present example embodiment, determining the set of dry upmix coefficients of the selected coding format may include determining a subset of the dry upmix coefficients of the selected coding format in order to define a linear mapping of the first channel of the downmix signal of the selected coding format approximating the first group of one or more channels of the selected coding format.

In the present example embodiment, determining the set of wet upmix coefficients of the selected coding format may include: determining an intermediate matrix based on a difference between a covariance of the first group of one or more channels of the selected coding format as received, and a covariance of the first group of one or more channels of the selected coding format as approximated by the linear mapping of the first channel of the downmix signal of the selected coding format. When multiplied by a predefined matrix, the intermediate matrix may correspond to a subset of the wet upmix coefficients of the selected coding format defining a linear mapping of the $N-1$ channels of the decorrelated signal as part of parametric reconstruction of the first group of one or more channels of the selected coding format. The subset of the wet upmix coefficients of the selected coding format may include more coefficients than the number of elements in the intermediate matrix.

In the present example embodiment, the output upmix parameters may include a set of upmix paramaters of a first type, referred to herein as dry upmix parameters, from which the subset of dry upmix coefficients is derivable, and a set of upmix parameters of a second type, referred to herein as wet upmix parameters, uniquely defining the intermediate matrix provided that the intermediate matrix belongs to a predefined matrix class. The intermediate matrix may have more elements than the number of elements in the subset of the wet upmix parameters of the selected coding format.

In the present example embodiment, a parametric reconstruction copy of the first group of one or more channels on a decoder side includes, as one contribution, a dry upmix signal formed by the linear mapping of the first channel of the downmix signal, and, as a further contribution, a wet upmix signal formed by the linear mapping of the N−1 channels of the decorrelated signal. The subset of dry upmix coefficients defines the linear mapping of the first channel of the downmix signal and the subset of wet upmix coefficients defines the linear mapping of the decorrelated signal. By outputting wet upmix parameters which are fewer than the number of coefficients in the subset of wet upmix coefficients, and from which the subset of wet upmix coefficients are derivable based on the predefined matrix and the predefined matrix class, the amount of information sent to a decoder side to enable reconstruction of the M-channel audio signal may be reduced. By reducing the amount of data needed for parametric reconstruction, the required bandwidth for transmission of a parametric representation of the M-channel audio signal, and/or the required memory size for storing such a representation, may be reduced.

The intermediate matrix may for example be determined such that a covariance of the signal obtained by the linear mapping of the N−1 channels of the decorrelated signal supplements the covariance of the first group of one or more channels as approximated by the linear mapping of the first channel of the downmix signal.

How to determine and employ the predefined matrix and the predefined matrix class is described in more detail on page 16, line 15 to page 20, line 2 in above-mentioned U.S. provisional patent application No. 61/974,544. See in particular equation (9) therein for examples of the predefined matrix.

In an example embodiment, determining the intermediate matrix may include determining the intermediate matrix such that a covariance of the signal obtained by the linear mapping of the N−1 channels of the decorrelated signal, defined by the subset of wet upmix coefficients, approximates, or substantially coincides with, the difference between the covariance of the first group of one or more channels as received and the covariance of the first group of one or more channels as approximated by the linear mapping of the first channel of the downmix signal. In other words, the intermediate matrix may be determined such that a reconstruction copy of the first group of one or more channels, obtained as a sum of a dry upmix signal formed by the linear mapping of the first channel of the downmix signal and a wet upmix signal formed by the linear mapping of the N−1 channels of the decorrelated signal completely, or at least approximately, reinstates the covariance of the first group of one or more channels as received.

In an example embodiment, the wet upmix parameters may include no more than N(N−1)/2 independently assignable wet upmix parameters. In the present example embodiment, the intermediate matrix may have $(N-1)^2$ matrix elements and may be uniquely defined by the wet upmix parameters provided that the intermediate matrix belongs to the predefined matrix class. In the present example embodiment, the subset of wet upmix coefficients may include N(N−1) coefficients.

In an example embodiment, the subset of dry upmix coefficients may include N coefficients. In the present example embodiment, the dry upmix parameters may include no more than N−1 dry upmix parameters, and the subset of dry upmix coefficients may be derivable from the N−1 dry upmix parameters using a predefined rule.

In an example embodiment, the determined subset of dry upmix coefficients may define a linear mapping of the first channel of the downmix signal corresponding to a minimum mean square error approximation of the first group of one or more channels, i.e. among the set of linear mappings of the first channel of the downmix signal, the determined set of dry upmix coefficients may define the linear mapping which best approximates the first group of one or more channels in a minimum mean square sense.

In an example embodiment, there is provided an audio encoding system comprising an encoding section configured to encode an M-channel audio signal as a two-channel audio signal and associated upmix parameters, where M≥4. The encoding section comprises: a downmix section configured to, for at least one of at least two coding formats corresponding to respective different partitions of the channels of the M-channel audio signal into respective first and second groups of one or more channels, compute, in accordance with the coding format, a two-channel downmix signal based on the M-channel audio signal. A first channel of the downmix signal is formed as a linear combination of the first group of one or more channels of the M-channel audio signal, and a second channel of the downmix signal is formed as a linear combination of the second group of one or more channels of the M-channel audio signal.

The audio encoding system further comprises a control section configured to select one of the coding formats based on any suitable criterion, e.g. signal properties, system load, user preference, network conditions. The audio encoding system further comprises a downmix interpolator, which cross-fades the downmix signal between two coding formats when a transition has been ordered by the control section. During such a transition, downmix signals for both coding formats may be computed. In addition to the downmix signal—or when applicable a cross fade thereof—the audio encoding system at least outputs signaling indicating a currently selected coding format and side information enabling parametric reconstruction of the M-channel audio signal on the basis of the downmix signal. If the system comprises multiple encoding sections operating in parallel, e.g., to encode respective groups of audio channels, then the control section may be implemented autonomous from each of these and being responsible for selecting a common coding format to be used by each of the encoding sections.

In an example embodiment, there is provided a computer program product comprising a computer-readable medium with instructions for performing any of the methods described in this section.

III. Example Embodiments

Figure 6:
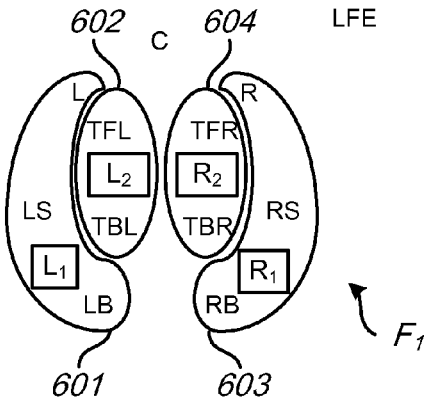
FIGS. 6-8 illustrate alternative ways to partition an 11.1-channel (or 7.1+4-channel or 7.1.4-channel) audio signal into groups of channels represented by respective downmix channels, according to example embodiments.
Figure 7:
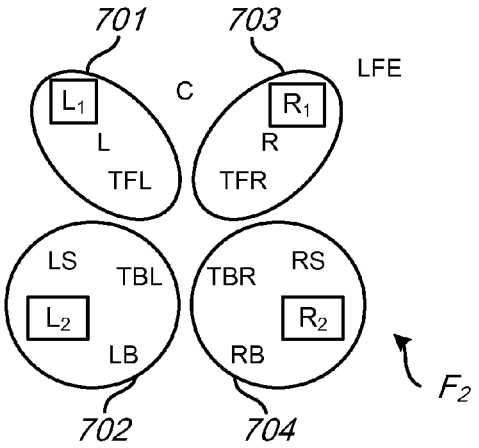
Figure 8:
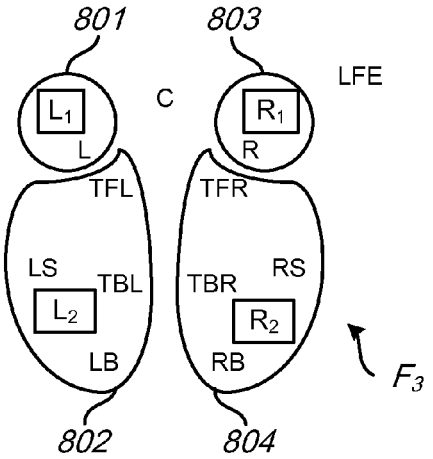

FIGS. 6-8 illustrate alternative ways to partition an 11.1-channel audio signal into groups of channels for parametric encoding of the 11.1-channel audio signal as a 5.1-channel audio signal. The 11.1-channel audio signal comprises the channels L (left), LS (left side), LB (left back), TFL (top front left), TBL (top back left), R (right), RS (right side), RB (right back), TFR (top front right), TBR (top back right), C (center), and LFE (low frequency effects). The five channels L, LS, LB, TFL and TBL form a five-channel audio signal representing a left half-space in a playback environment of the 11.1-channel audio signal. The three channels L, LS and LB represent different horizontal directions in the playback environment and the two channels TFL and TBL represent directions vertically separated from those of the three channels L, LS and LB. The two channels TFL and TBL may for example be intended for playback in ceiling speakers. Similarly, the five channels R, RS, RB, TFR and TBR form an additional five-channel audio signal representing a right half-space of the playback environment, the three channels R, RS and RB representing different horizontal directions in the playback environment and the two channels TFR and TBR representing directions vertically separated from those of the three channels R, RS and RB.

In order to represent the 11.1-channel audio signal as a 5.1-channel audio signal, the collection of channels L, LS, LB, TFL, TBL, R, RS, RB, TFR, TBR, C, and LFE may be partitioned into groups of channels represented by respective downmix channels and associated upmix parameters. The five-channel audio signal L, LS, LB, TFL, TBL may be represented by a two-channel downmix signal $L_1$, $L_2$ and associated upmix parameters, while the additional five-channel audio signal R, RS, RB, TFR, TBR may be represented by an additional two-channel downmix signal $R_1$, $R_2$ and associated additional upmix parameters. The channels C and LFE may be kept as separate channels also in the 5.1 channel representation of the 11.1-channel audio signal.

FIG. 6 illustrates a first coding format $F_1$, in which the five-channel audio signal L, LS, LB, TFL, TBL is partitioned into a first group 601 of channels L, LS, LB and a second group 602 of channels TFL, TBL, and in which the additional five-channel audio signal R, RS, RB, TFR, TBR is partitioned into an additional first group 603 of channels R, RS, RB and an additional second group 604 of channels TFR, TBR. In the first coding format $F_1$, the first group of channels 601 is represented by a first channel $L_1$ of the two-channel downmix signal, and the second group 602 of channels is represented by a second channel $L_2$ of the two-channel downmix signal. The first channel $L_1$ of the downmix signal may correspond to a sum of the first group 601 of channels as per $L_1$=L+LS+LB, and the second channel $L_2$ of the downmix signal may correspond to a sum of the second group 602 of channels as per $L_2$=TFL+TBL.

In some example embodiments, some or all of the channels may be rescaled prior to summing, so that the first channel $L_1$ of the downmix signal may correspond to a linear combination of the first group 601 of channels according to $L_1=c_1L+c_2LS+c_3LB$, and the second channel $L_2$ of the downmix signal may correspond to a linear combination of the second group 602 of channels according to $L_2=c_4TFL+c_5TBL$. The gains $c_2$, $c_3$, $c_4$, $c_5$ may for example coincide, while the gain $c_1$ may for example have a different value; e.g., $c_1$ may correspond to no rescaling at all. For example, values $c_1=1$ and $c_2=c_3=c_4=c_5=1/\sqrt{2}$ may be used. If, for example, the gains $c_1, \ldots, c_5$ applied to the respective channels L, LS, LB, TFL, TBL in the first coding format $F_1$ coincide with gains applied to these channels in the other coding formats $F_2$ and $F_3$, described below with reference to FIGS. 7 and 8, these gains do not affect how the downmix signal changes when switching between the different coding formats $F_1$, $F_2$, $F_3$, and the rescaled channels $c_1L$, $c_2LS$, $c_3LB$, $c_4TFL$, $c_5TBL$ may therefore be treated as if they were the original channels L, LS, LB, TFL, TBL. If, on the other hand, different gains are employed for rescaling of the same channel in different coding formats, switching between these coding formats may for example cause jumps between differently scaled versions of the channels L, LS, LB, TFL, TBL in the downmix signal, which may potentially cause audible artifacts on the decoder side. Such artifacts may for example be suppressed by employing interpolation from coefficients employed to form the downmix signal before the switch of coding format, to coefficients employed to form the downmix signal after the switch of coding format, and/or by employing interpolation of pre-decorrelation coefficients, as described below in relation to equations (3) and (4).

Similarly, the additional first group of channels 603 is represented by a first channel $R_1$ of the additional downmix signal, and the additional second group 604 of channels is represented by a second channel $R_2$ of the additional downmix signal.

The first coding format $F_1$ provides dedicated downmix channels $L_2$ and $R_2$ for representing the ceiling channels TFL, TBL, TFR and TBR. Use of the first coding format $F_1$ may therefore allow parametric reconstruction of the 11.1-channel audio signal with relatively high fidelity in cases where, e.g., a vertical dimension in the playback environment is important for the overall impression of the 11.1-channel audio signal.

FIG. 7 illustrates a second coding format $F_2$, in which the five-channel audio signal L, LS, LB, TFL, TBL is partitioned into first 701 and second 702 groups of channels represented by respective channels $L_1$, $L_2$ of a downmix signal, where the channels $L_1$ and $L_2$ correspond to sums of the respective groups 701 and 702 of channels, or linear combinations of the respective groups 701 and 702 of channels employing the same gains $c_1, \ldots, c_5$ for rescaling the respective channels L, LS, LB, TFL, TBL as in the first coding format $F_1$. Similarly, the additional five-channel audio signal R, RS, RB, TFR, TBR is partitioned into additional first 703 and second 704 groups of channels represented by respective channels $R_1$ and $R_2$.

The second coding format $F_2$ does not provide dedicated downmix channels for representing the ceiling channels TFL, TBL, TFR and TBR but may allow parametric reconstruction of the 11.1-channel audio signal with relatively high fidelity e.g. in cases where the vertical dimension in the playback environment is not as important for the overall impression of the 11.1-channel audio signal.

FIG. 8 illustrates a third coding format $F_3$, in which the five-channel audio signal L, LS, LB, TFL, TBL is partitioned into first 801 and second 802 groups of one or more channels represented by respective channels $L_1$ and $L_2$ of a downmix signal, where the channels $L_1$ and $L_2$ signal correspond to sums of the respective groups 801 and 802 of one or more channels, or linear combinations of the respective groups 801 and 802 of one or more channels employing the same coefficients $c_1, \ldots, c_5$ for rescaling of the respective channels L, LS, LB, TFL, TBL as in the first coding format $F_1$. Similarly, the additional five-channel signal R, RS, RB, TFR, TBR is partitioned into additional first 803 and second 804 groups of channels represented by respective channels $R_1$ and $R_2$. In the third coding format $F_3$, only the channel L is represented by the first channel $L_1$ of the downmix signal, while the four channels LS, LB, TFL and TBL are represented by the second channel $L_2$ of the downmix signal.

On an encoder side, which will be described with reference to FIGS. 1-5, a two-channel downmix signal $L_1$, $L_2$ is computed as a linear mapping of the five-channel audio signal $X=[L\ LS\ LB\ TFL\ TBL]^T$ according to $$\begin{bmatrix} L_1 \\ L_2 \end{bmatrix} = \begin{bmatrix} d_{1,1} & \dots & d_{1,5} \\ d_{2,1} & \dots & d_{2,5} \end{bmatrix} \begin{bmatrix} L \\ LS \\ LB \\ TFL \\ TBL \end{bmatrix} = DX, \tag{1}$$

where $d_{n,m}$, n=1, 2, m=1 . . . , 5 are downmix coefficients represented by a downmix matrix D. On a decoder side, which will be described with reference to FIGS. 9-13, parametric reconstruction of the five-channel audio signal $[L\ LS\ LB\ TFL\ TBL]^T$ is performed according to $$\hat{X} = \begin{bmatrix} c_{1,1} & c_{1,2} \\ \vdots & \vdots \\ c_{5,1} & c_{5,2} \end{bmatrix} \begin{bmatrix} L_1 \\ L_2 \end{bmatrix} + \begin{bmatrix} p_{11} & p_{1,2} & p_{1,3} \\ \vdots & \vdots & \vdots \\ p_{5,1} & p_{5,2} & p_{5,3} \end{bmatrix} \begin{bmatrix} z_1 \\ z_2 \\ z_3 \end{bmatrix} = \beta_L \begin{bmatrix} L_1 \\ L_2 \end{bmatrix} + \gamma_L Z, \tag{2}$$

where $c_{n,m}$, n=1, . . . , 5, m=1, 2 are dry upmix coefficients represented by a dry upmix matrix $\beta_L$, $P_{n,k}$, n=1, . . . , 5, k=1, 2, 3 are wet upmix coefficients represented by a wet upmix matrix $\gamma_L$, and $z_k$, k=1, 2, 3 are the channels of a three-channel decorrelated signal Z generated based on the downmix signal $L_1$, $L_2$.

FIG. 1 is a generalized block diagram of an encoding section 100 for encoding an M-channel audio signal as a two-channel downmix signal and associated upmix parameters, according to an example embodiment.

The M-channel audio signal is exemplified herein by the five-channel audio signal L, LS, LB, TFL and TBL described with reference to FIGS. 6-8. Example embodiments may also be envisaged in which the encoding section 100 computes a two-channel downmix signal based on an M-channel audio signal, where M=4, or M≥6.

The encoding section 100 comprises a downmix section 110 and an analysis section 120. For each of at the coding formats $F_1$, $F_2$, $F_3$, described with reference to FIGS. 6-8, the downmix section 110 computes, in accordance with the coding format, a two-channel downmix signal $L_1$, $L_2$ based on the five-channel audio signal L, LS, LB, TFL, TBL. In for example the first coding format $F_1$, the first channel $L_1$ of the downmix signal is formed as a linear combination (e.g. a sum) of the first group 601 of channels of the five-channel audio signal L, LS, LB, TFL, TBL, and the second channel $L_2$ of the downmix signal is formed as a linear combination (e.g. a sum) of the second group 602 of channels of the five-channel audio signal L, LS, LB, TFL, TBL. The operation performed by the downmix section 110 may for example be expressed as equation (1).

For each of the coding formats $F_1$, $F_2$, $F_3$, the analysis section 120 determines a set of dry upmix coefficients $\beta_L$ defining a linear mapping of the respective downmix signal $L_1$, $L_2$ approximating the five-channel audio signal L, LS, LB, TFL, TBL, and computes a difference between a covariance of the five-channel audio signal L, LS, LB, TFL, TBL as received and a covariance of the five-channel audio signal as approximated by the respective linear mapping of the respective downmix signal $L_1$, $L_2$. The computed difference is exemplified herein by a difference between the covariance matrix of the five-channel audio signal L, LS, LB, TFL, TBL as received and the covariance matrix of the five-channel audio signal as approximated by the respective linear mapping of the respective downmix signal $L_1$, $L_2$. For each of the coding formats $F_1$, $F_2$, $F_3$, the analysis section 120 determines a set of wet upmix coefficients $\gamma_L$, based on the respective computed difference, which together with the dry upmix coefficients $\beta_L$, allows for parametric reconstruction according to equation (2) of the five-channel audio signal L, LS, LB, TFL, TBL from the downmix signal $L_1$, $L_2$ and from a three-channel decorrelated signal determined at a decoder side based on the downmix signal $L_1$, $L_2$. The set of wet upmix coefficients $\gamma_L$ defines a linear mapping of the decorrelated signal such that the covariance matrix of the signal obtained by the linear mapping of the decorrelated signal approximates the difference between the covariance matrix of the five-channel audio signal L, LS, LB, TFL, TBL as received and the covariance matrix of the five-channel audio signal as approximated by the linear mapping of the downmix signal $L_1$, $L_2$.

The downmix section 110 may for example compute the downmix signal $L_1$, $L_2$ in the time domain, i.e. based on a time domain representation of the five-channel audio signal L, LS, LB, TFL, TBL, or in a frequency domain, i.e. based on a frequency domain representation of the five-channel audio signal L, LS, LB, TFL, TBL.

The analysis section 120 may for example determine the dry upmix coefficients $\beta_L$ and the wet upmix coefficients $\gamma_L$ based on a frequency-domain analysis of the five-channel audio signal L, LS, LB, TFL, TBL. The analysis section 120 may for example receive the downmix signal $L_1$, $L_2$ computed by the downmix section 110, or may compute its own version of the downmix signal $L_1$, $L_2$, for determining the dry upmix coefficients $\beta_L$ and the the wet upmix coefficients $\gamma_L$.

Figure 3:
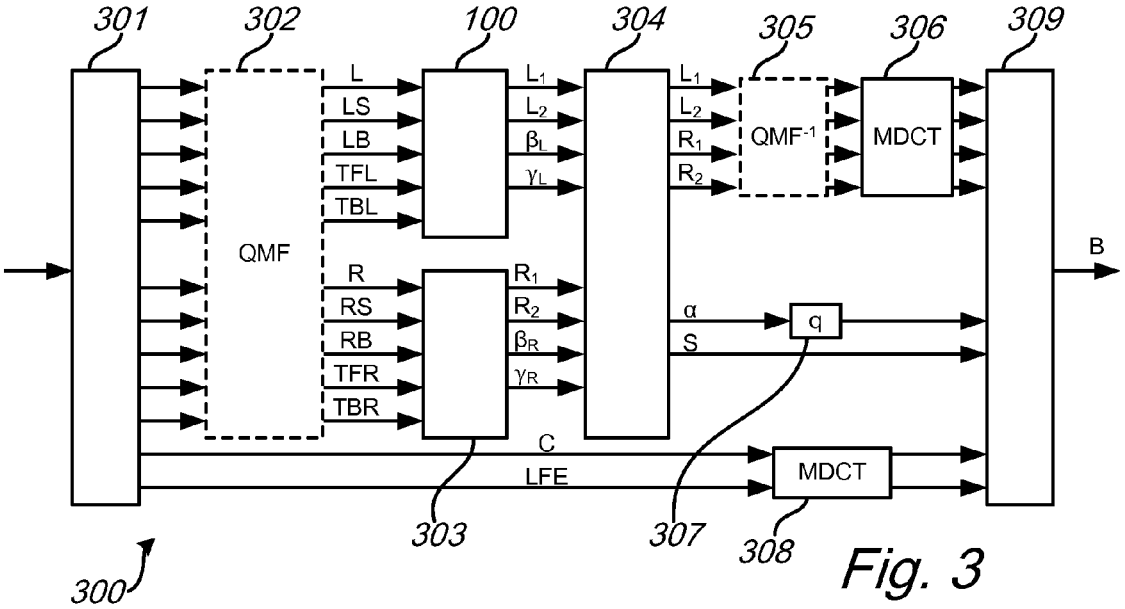
FIG. 3 is a generalized block diagram of an audio encoding system comprising the encoding section depicted in FIG. 1, according to an example embodiment.

FIG. 3 is a generalized block diagram of an audio encoding system 300 comprising the encoding section 100 described with reference to FIG. 1, according to an example embodiment. In the present example embodiment, audio content, e.g. recorded by one or more acoustic transducers 301, or generated by audio authoring equipment 301, is provided in the form of the 11.1-channel audio signal described with reference to FIGS. 6-8. A quadrature mirror filter (QMF) analysis section 302 (or filterbank) transforms the five-channel audio signal L, LS, LB TFL, TBL, time segment by time segment, into a QMF domain for processing by the encoding section 100 of the five-channel audio signal L, LS, LB TFL, TBL in the form of time/frequency tiles. (As will be explained further below, the QMF analysis section 302 and its counterpart, a QMF synthesis section 305, are optional.) The audio encoding system 300 comprises an additional encoding section 303 analogous to the encoding section 100 and adapted to encode the additional five-channel audio signal R,RS,RB,TFR and TBR as the additional two-channel downmix signal $R_1$, $R_2$ and associated additional dry upmix parameters $\beta_R$ and additional wet upmix parameters $\gamma_R$. The QMF analysis section 302 also transforms the additional five-channel audio signal R,RS, RB,TFR and TBR into a QMF domain for processing by the additional encoding section 303.

A control section 304 selects one of the coding formats $F_1$, $F_2$, $F_3$ based on the wet and dry upmix coefficients $\gamma_L$,$\gamma_R$ and $\beta_L$,$\beta_R$ determined by the encoding section 100 and the additional encoding section 303 for the respective coding formats $F_1$, $F_2$, $F_3$. For example, for each of the coding formats $F_1$, $F_2$, $F_3$, the control section 304 may compute a ratio $$E = \frac{E_{wet}}{E_{wet} + E_{dry}},$$

where $E_{wet}$ is a sum of squares of the wet upmix coefficients $\gamma_L$, and $\gamma_R$, and $E_{dry}$ is a sum of squares of the dry upmix coefficients $\beta_L$,$\beta_R$. The selected coding format may be associated with the minimal one of the ratios E of the coding formats $F_1$, $F_2$, $F_3$, i.e. the control section 304 may select the coding format corresponding to the smallest ratio E. The inventors have realized that a reduced value for the ratio E may be indicative of an increased fidelity of the 11.1-channel audio signal as reconstructed from the associated coding format.

In some example embodiments, the sum of squares $E_{dry}$ of the dry upmix coefficients $\beta_L$,$\beta_R$ may for example include an additional term with the value 1, corresponding to the fact that the channel C is transmitted to the decoder side and may be reconstructed without any decorrelation, e.g. only employing a dry upmix coefficient with the value 1.

In some example embodiments, the control section 304 may select coding formats for the two five-channel audio signals L, LS, LB TFL, TBL and R, RS, RB, TFR, TBR independently of each other, based on the wet and dry upmix coefficients $\gamma_L$,$\beta_L$ and the additional wet and dry upmix coefficients $\gamma_R$,$\beta_R$, respectively.

The audio encoding system 300 may then output the downmix signal $L_1$, $L_2$, and the additional downmix signal signal $R_1$, $R_2$, of the selected coding format, upmix parameters $\alpha$ from which the dry and wet upmix coefficients) $\beta_L$,$\gamma_L$ and the additional dry and wet upmix coefficients $\beta_R$, $\gamma_R$ associated with the selected coding format, are derivable, and signaling S indicating the selected coding format.

In the present example embodiment, the control section 304 outputs the downmix signal $L_1$, $L_2$, and the additional downmix signal $R_1$ $R_2$ of the selected coding format, upmix parameters $\alpha$ from which the dry and wet upmix coefficients) $\beta_L$,$\gamma_L$, and the additional dry and wet upmix coefficients $\beta_R$, $\gamma_R$, associated with the selected coding format, are derivable, and signaling S indicating the selected coding format. The downmix signal $L_1$, $L_2$ and the additional downmix signal $R_1$, $R_2$ are transformed back from the QMF domain by a QMF synthesis section 305 (or filterbank) and are transformed into a modified discrete cosine transform (MDCT) domain by a transform section 306. A quantization section 307 quantizes the upmix parameters $\alpha$. For example, uniform quantization with a step size of 0.1 or 0.2 (dimensionless) may be employed, followed by entropy coding in the form of Huffman coding. A coarser quantization with step size 0.2 may for example be employed to save transmission bandwidth, and a finer quantization with step size 0.1 may for example be employed to improve fidelity of the reconstruction on a decoder side. The channels C and LFE are also transformed into a MDCT domain by a transform section 308. The MDCT-transformed downmix signals and channels, the quantized upmix parameters, and the signaling, are then combined into a bitstream B by a multiplexer 309, for transmission to a decoder side. The audio encoding system 300 may also comprise a core encoder (not shown in FIG. 3) configured to encode the downmix signal $L_1$, $L_2$, the additional downmix signal $R_1$, $R_2$ and the channels C and LFE using a perceptual audio codec, such as Dolby Digital, MPEG AAC or a development thereof, before the downmix signals and the channels C and LFE are provided to the multiplexer 309. A clip gain, e.g. corresponding to −8.7 dB, may for example be applied to the downmix signal $L_1$, $L_2$, the additional downmix signal $R_1$, $R_2$, and the channel C, prior to forming the bitstream B. Alternatively, since the parameters are independent from the absolute level, the clip gains may as well be applied to all input channels prior to forming the linear combinations corresponding to $L_1$, $L_2$.

Embodiments may also be envisaged in which the control section 304 only receives the wet and dry upmix coefficients $\gamma_L$, $\gamma_R$, $\beta_L$, $\beta_R$ for the different coding formats $F_1$, $F_2$, $F_3$ (or sums of squares of the wet and dry upmix coefficients for the different coding formats) for selecting a coding format, i.e. the control section 304 need not necessarily receive the downmix signals $L_1$, $L_2$ $R_1$, $R_2$ for the different coding formats. In such embodiments, the control section 304 may for example control the encoding sections 100, 303 to deliver the downmix signals $L_1$, $L_2$ $R_1$, $R_2$, the dry upmix coefficients $\beta_L$, $\beta_R$ and the wet upmix coefficients $\gamma_L$, $\gamma_R$ for the selected coding format as output of the audio encoding system 300, or as input to the multiplexer 309.

If the selected coding format switches between coding formats, then interpolation may for example be performed between downmix coefficient values employed before and after the switch of coding format to form the downmix signal in accordance with equation (1). This is generally equivalent to an interpolation of the downmix signals produced in accordance with the respective sets of downmix coefficient values.

While FIG. 3 illustrates how the downmix signal may be generated in the QMF domain and then subsequently transformed back into the time domain, an alternative encoder fulfilling the same duties may be implemented without the QMF sections 302, 305, whereby it computes the downmix signal directly in the time domain. This is possible in situations where the downmix coefficients are not frequency-dependent, which generally holds true. With the alternative encoder, coding format transitions can be handled either by crossfading between the two downmix signals for the respective coding formats or by interpolating between the downmix coefficients (including coefficients that are zero-valued in one of the formats) producing the downmix signals. Such alternative encoder may have lower delay/latency and/or lower computational complexity.

Figure 2:
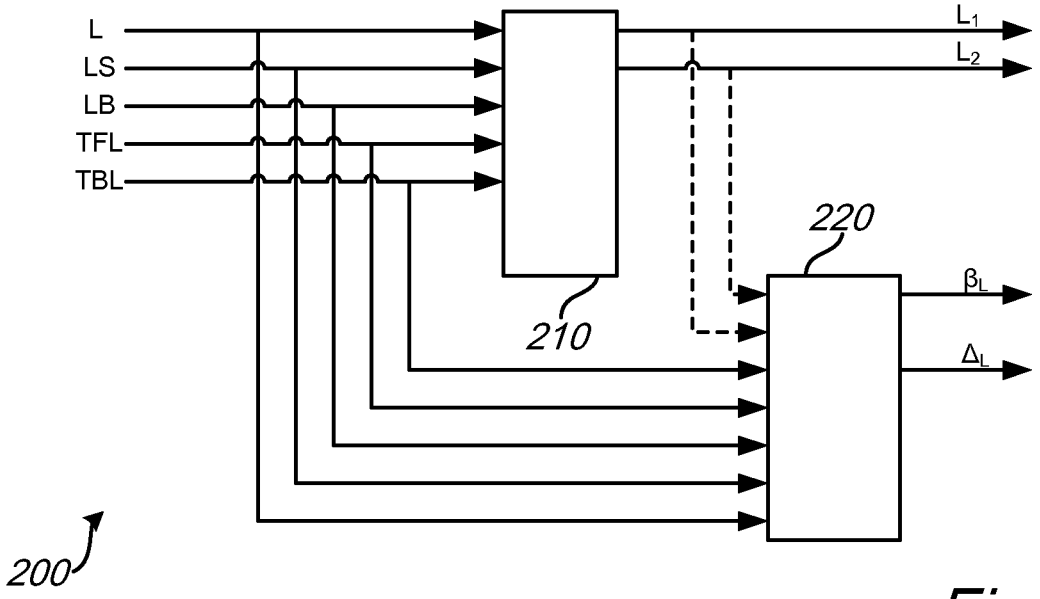

FIG. 2 is a generalized block diagram of an encoding section 200 similar to the encoding section 100, described with reference to FIG. 1, according to an example embodiment. The encoding section 200 comprises a downmix section 210 and an analysis section 220. As in the encoding section 100, described with reference to FIG. 1, the downmix section 210 computes a two-channel downmix signal $L_1$, $L_2$ based on the five-channel audio signal L, LS, LB, TFL, TBL for each of the coding formats $F_1$, $F_2$, $F_3$, and the analysis section 220 determines respective sets of dry upmix coefficients $\beta_L$, and computes differences $\Delta_L$ between a covariance matrix of the five-channel audio signal L, LS, LB, TFL, TBL as received and covariance matrices of the five-channel audio signal as approximated by the respective linear mappings of the respective downmix signals.

In contrast to the analysis section 120 in the encoding section 100, described with reference to FIG. 1, the analysis section 220 does not compute wet upmix parameters for all the coding formats. Instead, the computed differences $\Delta_L$ are provided to the control section 304 (see FIG. 3) for selection of a coding format. Once a coding format has been selected based on the computed differences $\Delta_L$, wet upmix coefficients (to be included in a set of upmix parameters) for the selected coding format may then be determined by the control section 304. Alternatively, the control section 304 is responsible for selecting the coding format on the basis of the computed differences $\Delta_L$ between the covariance matrices discussed above, but instructs the analysis section 220, via signaling in the upstream direction, to compute the wet upmix coefficients $\gamma_L$; according to this alternative (not shown), the analysis section 220 has the ability to output both differences and wet upmix coefficients.

In the present example embodiment, the set of wet upmix coefficients are determined such that a covariance matrix of a signal obtained by a linear mapping of the decorrelated signal, defined by the wet upmix coefficients, supplements a covariance matrix of the five-channel audio signal as approximated by the linear mapping of the downmix signal of the selected coding format. In other words, the wet upmix parameters need not necessarily be determined to achieve full covariance reconstruction when reconstructing the five-channel audio signal L, LS, LB, TFL, TBL on a decoder side. The wet upmix parameters may be determined to improve fidelity of the five-channel audio signal as reconstructed, but, if for example the number of decorrelators on the decoder side is limited, the wet upmix parameters may be determined so as to allow reconstruction of as much as possible of the covariance matrix of the five-channel audio signal L, LS, LB, TFL, TBL.

Embodiments may be envisaged, in which audio encoding systems similar to the audio encoding system 300, described with reference to FIG. 3, comprise one or more encoding sections 200 of the type described with reference to FIG. 2.

Figure 4:
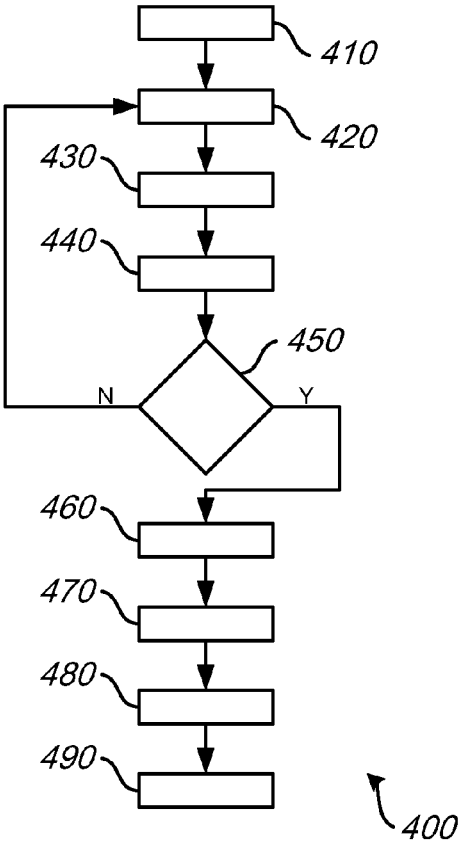
FIGS. 4 and 5 are flow charts of audio encoding methods for encoding M-channel audio signals as two-channel downmix signals and associated upmix parameters, according to example embodiments.

FIG. 4 is flow chart of an audio encoding method 400 for encoding an M-channel audio signal as a two-channel downmix signal and associated upmix parameters, according to an example embodiment. The audio encoding method 400 is exemplified herein by a method performed by an audio encoding system comprising the encoding section 200, described with reference to FIG. 2.

The audio encoding method 400 comprises: receiving 410 the five-channel audio signal L, LS, LB, TFL, TBL; computing 420, in accordance with a first one of the coding formats $F_1$, $F_2$, $F_3$ described with reference to FIGS. 6-8, the two-channel downmix signal $L_1$, $L_2$ based on the five-channel audio signal L, LS, LB, TFL, TBL; determining 430 the set of dry upmix coefficients $\beta_L$ in accordance with the coding format; and computing 440 the difference $\Delta_L$ in accordance with the coding format. The audio encoding method 400 comprises: determining 450 whether differences $\Delta_L$ have been computed for each of the coding formats $F_1$, $F_2$, $F_3$. As long as a difference $\Delta_L$ remains to be computed for at least one coding format, the audio encoding method 400 method returns to computing 420 the downmix signal $L_1$, $L_2$ in accordance with the coding format next in line, which is indicated by N in the flow chart.

If differences $\Delta_L$ have been computed for each of the coding formats $F_1$, $F_2$, $F_3$, indicated by Y in the flow chart, the method 400 proceeds by selecting 460 one of the coding formats $F_1$, $F_2$, $F_3$, based on the respective computed differences $\Delta_L$; and determining 470 the set of wet upmix coefficients, which together with the dry upmix coefficients $\beta_L$ of the selected coding format allow for parametric reconstruction of the five-channel audio signal L, LS, LB, TFL, TBLM according to equation (2). The audio encoding method 400 further comprises: outputting 480 the downmix signal $L_1$, $L_2$ of the selected coding format, and upmix parameters from which the dry and wet upmix coefficients associated with the selected coding format are derivable; and outputting 490 the signaling S indicating the selected coding format.

Figure 5:
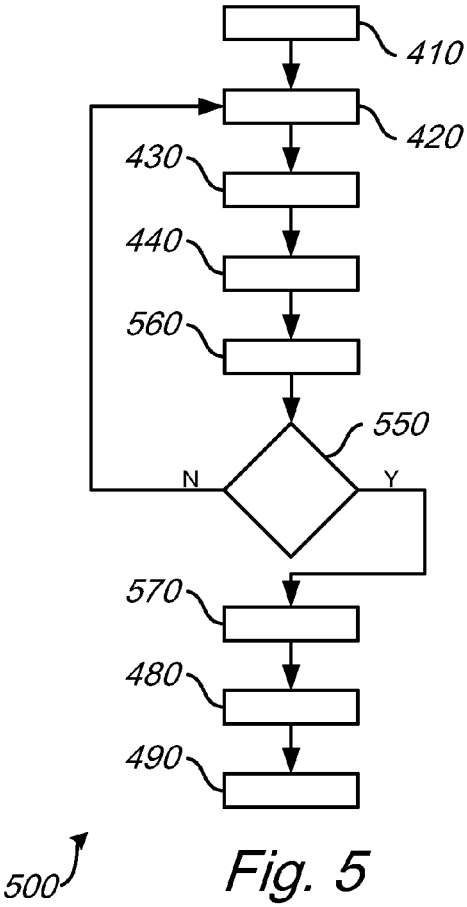

FIG. 5 is a flow chart of an audio encoding method 500 for encoding an M-channel audio signal as a two-channel downmix signal and associated upmix parameters, according to an example embodiment. The audio encoding method 500 is exemplified herein by a method performed by the audio encoding system 300, described with reference to FIG. 3.

Similarly to the audio encoding method 400 described with reference to FIG. 4, the audio encoding method 500 comprises: receiving 410 the five-channel audio signal L, LS, LB, TFL, TBL; computing 420, in accordance with a first one of the coding formats $F_1$, $F_2$, $F_3$, the two-channel downmix signal $L_1$, $L_2$ based on the five-channel audio signal L, LS, LB, TFL, TBL; determining 430 the set of dry upmix coefficients $\beta_L$ in accordance with the coding format; and computing 440 the difference $\Delta_L$ in accordance with the coding format. The audio encoding method 500 further comprises determining 560 the set of wet upmix coefficients $\gamma_L$ which together with the dry upmix coefficients $\beta_L$ of the coding format allows for parametric reconstruction of the M-channel audio signal in accordance with equation (2). The audio encoding method 500 comprises: determining 550 whether wet and dry upmix coefficients $\gamma_L$, $\beta_L$ have been computed for each of the coding formats $F_1$, $F_2$, $F_3$. As long as wet and dry upmix coefficients $\gamma_L$, $\beta_L$ remain to be computed for at least one coding format, the audio encoding method 500 method returns to computing 420 the downmix signal $L_1$, $L_2$ in accordance with the coding format next in line, which is indicated by N in the flow chart.

If wet and dry upmix coefficients $\gamma_L$,$\beta_L$ have been computed for each of the coding formats $F_1$, $F_2$, $F_3$, indicated by Y in the flow chart, the audio encoding method 500 proceeds by selecting 570 one of the coding formats $F_1$, $F_2$, $F_3$, based on the respective computed wet and dry upmix coefficients $\gamma_L$,$\beta_L$; outputting 480 the downmix signal $L_1$, $L_2$ of the selected coding format, and upmix parameters from which the dry and wet upmix coefficients $\beta_L$, $\gamma_L$ associated with the selected coding format are derivable; and outputting 490 signaling indicating the selected coding format.

Figure 9:
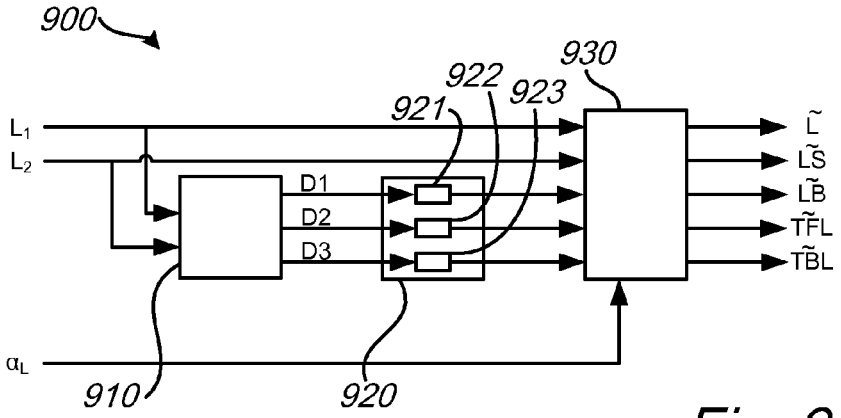
FIG. 9 is a generalized block diagram of a decoding section for reconstructing an M-channel audio signal based on a two-channel downmix signal and associated upmix parameters, according to an example embodiment.

FIG. 9 is a generalized block diagram of a decoding section 900 for reconstructing an M-channel audio signal based on a two-channel downmix signal and associated upmix parameters $\alpha_L$, according to an example embodiment.

In the present example embodiment, the downmix signal is exemplified by the downmix signal $L_1$, $L_2$ output by the encoding section 100, described with reference to FIG. 1. In the present example embodiment, dry and wet upmix parameters $\beta_L$,$\gamma_L$ output by the encoding section 100, and which are adapted for parametric reconstruction of the five-channel audio signal L, LS, LB, TFL, TBL, are derivable from the upmix parameters $\alpha_L$. However, embodiments may also be envisaged in which the upmix parameters $\alpha_L$, are adapted for parametric reconstruction of an M-channel audio signal, where M=4, or M≥6.

The decoding section 900 comprises a pre-decorrelation section 910, a decorrelating section 920 and a mixing section 930. The pre-decorrelation section 910 determines a set of pre-decorrelation coefficients based on a selected coding format employed on an encoder side to encode the five-channel audio signal L, LS, LB, TFL, TBL. As described below with reference to FIG. 10, the selected coding format may be indicated via signaling from the encoder side. The pre-decorrelation section 910 computes a decorrelation input signal $D_1$, $D_2$, $D_3$ as a linear mapping of the downmix signal $L_1$, $L_2$, where the set of pre-decorrelation coefficients is applied to the downmix signal $L_1$, $L_2$.

The decorrelating section 920 generates a decorrelated signal based on the decorrelation input signal $D_1$, $D_2$, $D_3$. The decorrelated signal is exemplified herein by three-channels, each generated by processing one of the channels of decorrelation input signal in a decorrelator 921-923 of the decorrelating section 920, e.g. including applying linear filters to the respective channels of the decorrelation input signal $D_1$, $D_2$, $D_3$.

The mixing section 930 determines the sets of wet and dry upmix coefficients $\beta_L,\gamma_L$ based on the received upmix parameters $\alpha_L$, and the selected coding format employed on an encoder side to encode the five-channel audio signal L, LS, LB, TFL, TBL. The mixing section 930 performs parametric reconstruction of the five-channel audio signal L, LS, LB, TFL, TBL in accordance with equation (2), i.e. it computes a dry upmix signal as a linear mapping of the downmix signal $L_1$, $L_2$, wherein the set of dry upmix coefficients $\beta_L$ is applied to the downmix signal $L_1$, $L_2$; computes a wet upmix signal as a linear mapping of the decorrelated signal, where the set of wet upmix coefficients $\gamma_L$ is applied to the decorrelated signal; and combines the dry and wet upmix signals to obtain a multidimensional reconstructed signal $\tilde{L}$, $\widetilde{LS}$, $\widetilde{LB}$, $\widetilde{TFL}$, $\widetilde{TBL}$ corresponding to the five-channel audio signal L, LS, LB, TFL, TBL to be reconstructed.

In some example embodiments, the received upmix parameters $\alpha_L$ may include the wet and dry upmix coefficients $\beta_L,\gamma_L$ themselves, or may correspond to a more compact form, including fewer parameters than the number of wet and dry upmix coefficients $\beta_L,\gamma_L$, from which the wet and dry upmix coefficients $\beta_L,\gamma_L$ may be derived on the decoder side based on knowledge of the particular compact form employed.

Figure 11:
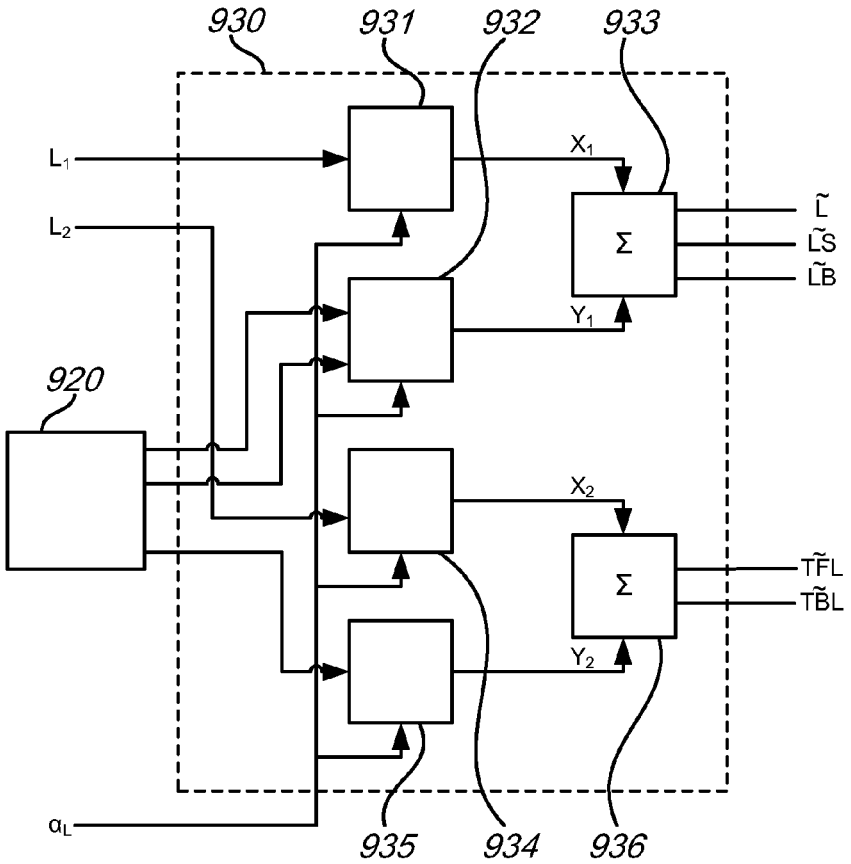
FIG. 11 is a generalized block diagram of a mixing section comprised in the decoding section depicted in FIG. 9, according to an example embodiment.

FIG. 11 illustrates operation of the mixing section 930, described with reference to FIG. 9, in an example scenario where the downmix signal $L_1$, $L_2$ represents the five-channel audio signal L, LS, LB, TFL, TBL in accordance with the first coding format $F_1$, described with reference to FIG. 6. It will be appreciated that operation of the mixing section 930 may be similar in example scenarios where the downmix signal $L_1$, $L_2$ represents the five-channel audio signal L, LS, LB, TFL, TBL in accordance with any of the second and third coding formats $F_2$, $F_3$. In particular, the mixing section 930 may temporarily activate further instances of the upmix sections and combining sections to be described imminently, to enable a cross-fade between two coding formats, which may require contemporaneous availability of the computed downmix signals.

In the present example scenario, the first channel $L_1$ of the downmix signal represents the three channels L, LS, LB, and the second channel $L_2$ of the downmix signal represents the two channels TFL, TBL. The pre-decorrelation section 910 determines the pre-decorrelation coefficients such that two channels of the decorrelated signal are generated based on the first channel $L_1$ of the downmix signal and such that one channel of the decorrelated signal is generated based on the second channel $L_2$ of the downmix signal.

A first dry upmix section 931 provides a three-channel dry upmix signal $X_1$ as a linear mapping of the first channel $L_1$ of the downmix signal, where a subset of the dry upmix coefficients, derivable from the received upmix parameters $\alpha_L$, is applied to the first channel $L_1$ of the downmix signal. A first wet upmix section 932 provides a three-channel wet upmix signal $Y_1$ as a linear mapping of the two channels of the decorrelated signal, where a subset of the wet upmix coefficients, derivable from the received upmix parameters $\alpha_L$, is applied to the two channels of the decorrelated signal. A first combining section 933 combines the first dry upmix signal $X_1$ and the first wet upmix signal $Y_1$ into reconstructed versions $\tilde{L}$, $\widetilde{LS}$, $\widetilde{LB}$, of the channels L,LS,LB.

Similarly, a second dry upmix section 934 provides a two-channel dry upmix signal $X_2$ as a linear mapping of the second channel $L_2$ of the downmix signal, and a second wet upmix section 935 provides a two-channel wet upmix signal $Y_2$ as a linear combination of the one channel of the decorrelated signal. A second combining section 936 combines the second dry upmix signal $X_2$ and the second wet upmix signal $Y_2$ into reconstructed versions $\widetilde{TFL}$, $\widetilde{TBL}$ of the channels TFL, TBL.

Figure 10:
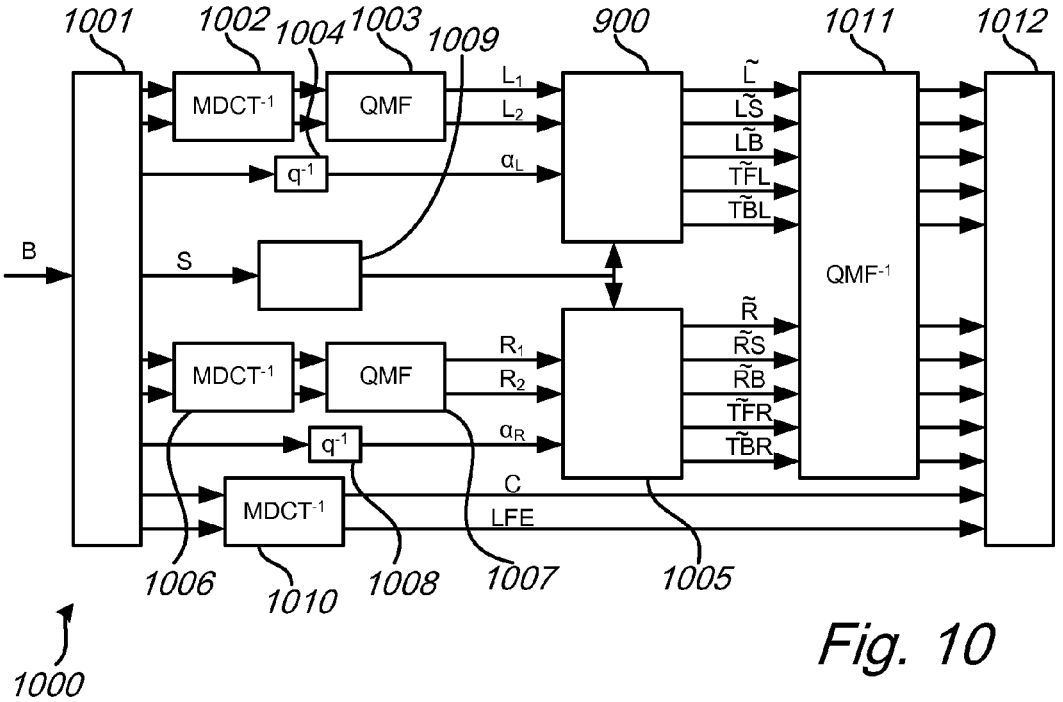
FIG. 10 is a generalized block diagram of an audio decoding system comprising the decoding section depicted in FIG. 9, according to an example embodiment.

FIG. 10 is a generalized block diagram of an audio decoding system 1000 comprising the decoding section 900, described with reference to FIG. 9, according to an example embodiment. A receiving section 1001, e.g. including a demultiplexer, receives the bitstream B transmitted from the audio encoding system 300, described with reference to FIG. 3, and extracts the downmix signal $L_1$, $L_2$, the additional downmix signal $R_1$, $R_2$, and the upmix parameters $\alpha$, as well as the channels C and LFE, from the bitstream B. The upmix parameters a may for example comprise first and second subsets $\alpha_L$, and $\alpha_R$, associated with the left-hand side and the right-hand side, respectively, of the 11.1-channel audio signal L, LS, LB, TFL, TBL, R, RS, RB, TFR, TBR, C, LFE to be reconstructed.

In case the downmix signal $L_1$, $L_2$, the additional downmix signal $R_1$, $R_2$ and/or the channels C and LFE are encoded in the bitstream B using a perceptual audio codec such as Dolby Digital, MPEG AAC, or developments thereof, the audio decoding system 1000 may comprise a core decoder (not shown in FIG. 10) configured to decode the respective signals and channels when extracted from the bitstream B.

A transform section 1002 transforms the downmix signal $L_1$, $L_2$ by performing inverse MDCT and a QMF analysis section 1003 transforms the downmix signal $L_1$, $L_2$ into a QMF domain for processing by the decoding section 900 of the downmix signal $L_1$, $L_2$ in the form of time/frequency tiles. A dequantization section 1004 dequantizes the first subset of upmix parameters $\alpha_L$, e.g., from an entropy coded format, before supplying it to the decoding section 900. As described with reference to FIG. 3, quantization may have been performed with one of two different step sizes, e.g. 0.1 or 0.2. The actual step size employed may be predefined, or may be signaled to the audio decoding system 1000 from the encoder side, e.g. via the bitstream B.

In the present example embodiment, the audio decoding system 1000 comprises an additional decoding section 1005 analogous to the decoding section 900. The additional decoding section 1005 is configured to receive the additional two-channel downmix signal $R_1$, $R_2$ described with reference to FIG. 3, and the second subset $\alpha_R$ of upmix parameters, and to provide a reconstructed version $\tilde{R}$, $\widetilde{RS}$, $\widetilde{TFR}$, $\widetilde{TBR}$, $\widetilde{RB}$, of the additional five-channel audio signal R, RS, RB, TFR, TBR based on the additional downmix signal $R_1$, $R_2$ and the second subset $\alpha_R$ of upmix parameters.

A transform section 1006 transforms the additional downmix signal $R_1$, $R_2$ by performing inverse MDCT and a QMF analysis section 1007 transforms the additional downmix signal $R_1$, $R_2$ into a QMF domain for processing by the additional decoding section 1005 of the additional downmix signal $R_1$, $R_2$ in the form of time/frequency tiles. A dequantization section 1008 dequantizes the second subset of upmix parameters $\alpha_R$, e.g., from an entropy coded format, before supplying them to the additional decoding section 1005.

In example embodiments where a clip gain has been applied to the downmix signal $L_1$, $L_2$, the additional downmix signal $R_1$ $R_2$, and the channel C on an encoder side, a corresponding gain, e.g. corresponding to 8.7 dB, may be applied to these signals in the audio decoding system 1000 to compensate for the clip gain.

A control section 1009 receives the signaling S indicating a selected one of the coding formats $F_1$, $F_2$, $F_3$, employed on the encoder side to encode the 11.1-channel audio signal into the downmix signal $L_1$, $L_2$ and the additional downmix signal $R_1$, $R_2$ and associated upmix parameters $\alpha$. The control section 1009 controls the decoding section 900 (e.g. the pre-decorrelation section 910 and the mixing section 920 therein) and the additional decoding section (1005) to perform parametric reconstruction in accordance with the indicated coding format.

In the present example embodiment, the reconstructed versions of the five-channel audio signal L,LS,LB,TFL,TBL and the additional five-channel audio signal R, RS, RB, TFL, TBL output by the decoding section 900 and the additional decoding section 1005, respectively, are transformed back from the QMF domain by a QMF synthesis section 1011 before being provided together with the channels C and LFE as output of the audio decoding system 1000 for playback on multi-speaker system 1012. A transform section 1010 transforms the channels C and LFE into the time domain by performing inverse MDCT before these channels are included in the output of the audio decoding system 1000.

The channels C and LFE may for example be extracted from the bitstream B in a discretely coded form and the audio decoding system 1000 may for example comprise single-channel decoding sections (not shown in FIG. 10) configured to decode the respective discretely coded channels. The single-channel decoding sections may for example include core decoders for decoding audio content encoded using a perceptual audio codec such as Dolby Digital, MPEG AAC, or developments thereof.

In the present example embodiment, the pre-decorrelation coefficients are determined by the pre-decorrelation section 910 such that, in each of the coding formats $F_1$, $F_2$, $F_3$, each of the channels of decorrelation input signal $D_1$, $D_2$, $D_3$ coincides with a channel of the downmix signal $L_1$, $L_2$, in accordance with Table 1.

TABLE 1

| Channel of decorrelation input signal | Coding format $F_1$ | Coding format $F_2$ | Coding format $F_3$ |
|---|---|---|---|
| D1 | $L_1$ = L + LS + LB | $L_1$ = L + TFL | $L_2$ = LS + LB + TFL + TBL |
| D2 | $L_1$ = L + LS + LB | $L_2$ = LS + LB + TBL | $L_2$ = LS + LB + TFL + TBL |
| D3 | $L_2$ = TFL + TBL | $L_2$ = LS + LB + TBL | $L_2$ = LS + LB + TFL + TBL |

As can be seen in Table 1, the channel TBL contributes, via the downmix signal $L_1$, $L_2$, to a third channel D3 of the decorrelation input signal in all three of the coding formats $F_1$, $F_2$, $F_3$, while each of the pairs of channels LS, LB and TFL, TBL contributes, via the downmix signal $L_1$, $L_2$, to the third channel D3 of the decorrelation input signal in at least two of the coding formats, respectively.

Table 1 shows that each of the channels L and TFL contributes, via the downmix signal $L_1$, $L_2$, to a first channel D1 of the decorrelation input signal in two of the coding formats, respectively, and the pair of channels LS, LB contributes, via the downmix signal $L_1$, $L_2$, to the first channel D1 of the decorrelation input signal in at least two of the coding formats.

Table 1 also shows that the three channels LS, LB, TBL contribute, via the downmix signal $L_1$, $L_2$, to a second channel D2 of the decorrelation input signal in both the second and the third coding formats $F_3$, $F_3$, while the pair of channels LS, LB contributes, via the downmix signal $L_1$, $L_2$, to the second channel D2 of the decorrelation input signal in all three coding formats $F_1$, $F_2$, $F_3$.

When the indicated coding format switches between different coding formats, the input to the decorrelators 921-923 changes. In the present example embodiment, at least some portions of the decorrelation input signals D1, D2, D3 will remain during the switch, i.e. at least one channel of the five-channel audio signal L, LS, LB, TFL, TBL will remain in each channel of the decorrelation input signal D1, D2, D3 in any switch between two of the coding formats $F_1$, $F_2$, $F_3$, which allows for a smoother transition between the coding formats, as perceived by a listener during playback of the M-channel audio signal as reconstructed.

The inventors have realized that since the decorrelated signal may be generated based on a section of the downmix signal $L_1$, $L_2$ corresponding to several time frames, during which a switch of coding format may occur, audible artifacts may potentially be generated in the decorrelated signal as a result of switching of coding formats. Even if the wet and dry upmix coefficients $\beta_L$, $\gamma_L$ are interpolated in response to a transition between coding formats, artifacts caused in the decorrelated signal may still persist in the five-channel audio signal L, LS, LB, TFL, TBL as reconstructed. Providing the decorrelation input signal D1, D2, D3 in accordance with Table 1 may suppress audible artifacts in the decorrelated signal caused by switching of coding format, and may improve playback quality of the five-channel audio signal L, LS, LB, TFL, TBL as reconstructed.

Although Table 1 is expressed in terms of coding formats $F_1$, $F_2$, $F_3$ for which the channels of the downmix signal $L_1$, $L_2$ are generated as sums of the first and second groups of channels, respectively, the same values for the pre-decorrelation coefficients may for example be employed when the channels of the downmix signal have been formed as linear combinations of the first and second groups of channels, respectively, such that the channels of the decorrelation input signal D1, D2, D3 coincide with channels of the downmix signal $L_1$, $L_2$, in accordance with Table 1. It will be appreciated that the playback quality of the five-channel audio signal as reconstructed may be improved in this way also in when the channels of the downmix signal are formed as linear combinations of the first and second groups of channels, respectively.

To further improve playback quality of the five-channel audio signal as reconstructed, interpolation of values of the pre-decorrelation coefficients may for example be performed in response to switching of the coding format. In the first coding format $F_1$, the decorrelation input signal D1, D2, D3 may be determined as $$\begin{bmatrix} D_1 \\ D_2 \\ D_3 \end{bmatrix} = \begin{bmatrix} 1 & 0 \\ 1 & 0 \\ 0 & 1 \end{bmatrix} \begin{bmatrix} L_1 \\ L_2 \end{bmatrix}, \tag{3}$$

while in the second coding format $F_2$, the decorrelation input signal D1, D2, D3 may be determined as $$\begin{bmatrix} D_1 \\ D_2 \\ D_3 \end{bmatrix} = \begin{bmatrix} 1 & 0 \\ 0 & 1 \\ 0 & 1 \end{bmatrix} \begin{bmatrix} L_1 \\ L_2 \end{bmatrix}. \quad (4)$$

In response to a switch from the first coding format $F_1$ to the second coding format $F_2$, continuous or linear interpolation may for example be performed between the pre-decorrelation matrix in equation (3) and the pre-decorrelation matrix in equation (4).

The downmix signal $L_1$, $L_2$ in equations (3) and (4) may for example be in the QMF domain, and when switching between coding formats, the downmix coefficients employed on an encoder side to compute the downmix signal $L_1$, $L_2$ according to equation (1) may have been interpolated during e.g. 32 QMF slots. The interpolation of the pre-decorrelation coefficients (or matrices) may for example be synchronized with the interpolation of the downmix coefficients, e.g. it may be performed during the same 32 QMF slots. The interpolation of the pre-decorrelation coefficients may for example be a broadband interpolation, e.g. employed for all frequency bands decoded by the audio decoding system 1000.

The dry and wet upmix coefficients $\beta_L,\gamma_L$ may also be interpolated. Interpolations of the dry and wet upmix coefficients $\beta_L,\gamma_L$ may for example be controlled via the signaling S from the encoder side to improve transient handling. In case of a switch of coding format, the interpolation scheme selected on the encoder side, for interpolating the dry and wet upmix coefficients $\beta_L,\gamma_L$ on the decoder side, may for example be an interpolation scheme appropriate for a switch of coding format, which may be different than interpolation schemes employed for the dry and wet upmix coefficients $\beta_L,\gamma_L$ when no switch of coding format occurs.

In some example embodiments, at least one different interpolation scheme may be employed in the decoding section 900 than in the additional decoding section 1005.

Figure 12:
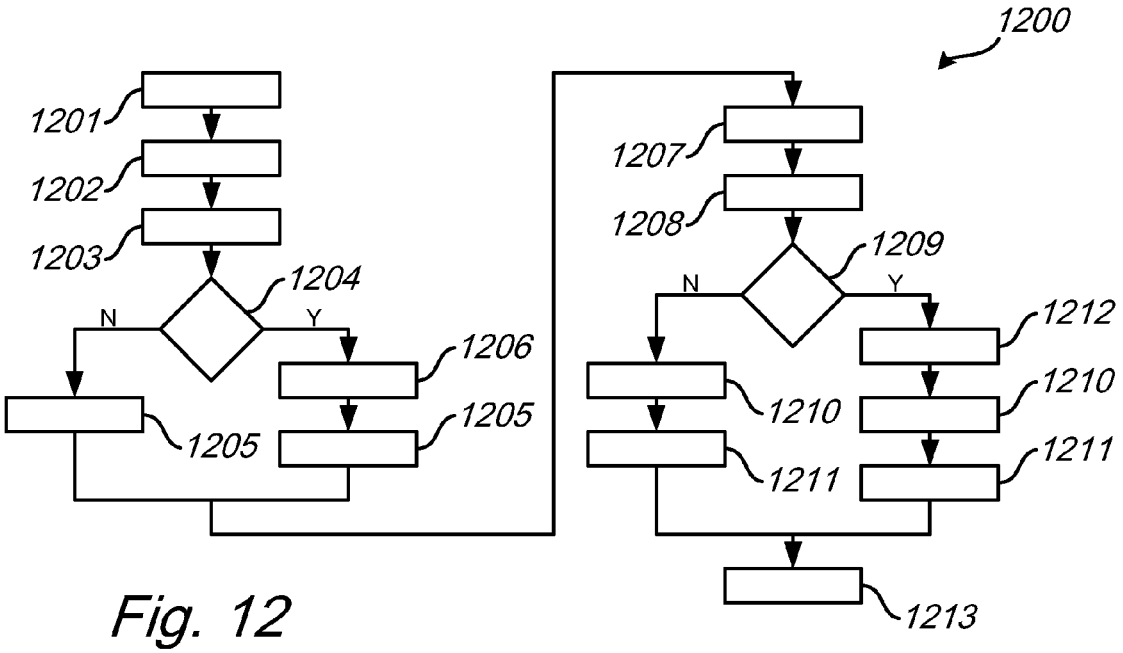
FIG. 12 is a flow chart of an audio decoding method for reconstructing an M-channel audio signal based on a two-channel downmix signal and associated upmix parameters, according to an example embodiment.

FIG. 12 is a flow chart of an audio decoding method 1200 for reconstructing an M-channel audio signal based on a two-channel downmix signal and associated upmix parameters, according to an example embodiment. The decoding method 1200 is exemplified herein by a decoding method which may be performed by the audio decoding system 1000, described with reference to FIG. 10.

The audio decoding method 1200 comprises: receiving 1201 the two-channel downmix signal $L_1$, $L_2$ and the upmix parameters $\alpha_L$ for parametric reconstruction of the five-channel audio signal L, LS, LB, TFL, TBL, described with reference to FIGS. 6-8, based on the downmix signal $L_1$, $L_2$; receiving 1202 the signaling S indicating a selected one of the coding formats $F_1$, $F_2$, $F_3$, described with reference to FIGS. 6-8; and determining 1203 the set of pre-decorrelation coefficients based on the indicated coding format.

The audio decoding method 1200 comprises detecting 1204 whether the indicated format switches from one coding format to another. If a switch is not detected, indicated by N in the flow chart, the next step is computing 1205 the decorrelation input signal $D_1$, $D_2$, $D_3$ as a linear mapping of the downmix signal $L_1$, $L_2$, wherein the set of pre-decorrelation coefficients is applied to the downmix signal. If, on the other hand, a switch of coding format is detected, indicated by Y in the flow chart, the next step is instead performing 1206 interpolation in the form of a gradual transition from pre-decorrelation coefficient values of one coding format to pre-decorrelation coefficient values of another coding format, and then computing 1205 the decorrelation input signal $D_1$, $D_2$, $D_3$ employing the interpolated pre-decorrelation coefficient values.

The audio decoding method 1200 comprises generating 1207 a decorrelated signal based on the decorrelation input signal $D_1$, $D_2$, $D_3$; and determining 1208 the sets of wet and dry upmix coefficients $\beta_L,\gamma_L$ based on the received upmix parameters and the indicated coding format.

If no switch of coding format is detected, indicated by a branch N from a decision box 1209, the method 1200 continues by computing 1210 a dry upmix signal as a linear mapping of the downmix signal, where the set of dry upmix coefficients $\beta_L$ is applied to the downmix signal $L_1$, $L_2$; and computing 1211 a wet upmix signal as a linear mapping of the decorrelated signal, where the set of wet upmix coefficients $\gamma_L$ is applied to the decorrelated signal. If, on the other hand, the indicated coding format switches from one coding format to another indicated by the branch Y from the decision box 1209, the method instead continues by: performing 1212 interpolation from values of dry and wet upmix coefficients (including zero-valued coefficients) applicable for one coding format, to values of the dry and wet upmix coefficients (including zero-valued coefficients) applicable for another coding format; computing 1210 a dry upmix signal as a linear mapping of the downmix signal $L_1$, $L_2$, where the interpolated set of dry upmix coefficients is applied to the downmix signal $L_1$, $L_2$; and computing 1211 a wet upmix signal as a linear mapping of the decorrelated signal, where the interpolated set of wet upmix coefficients is applied to the decorrelated signal. The method also comprises: combining 1213 the dry and wet upmix signals to obtain the multidimensional reconstructed signal $\tilde{L}$, $\widetilde{LS}$, $\widetilde{LB}$, $\widetilde{TFL}$, $\widetilde{TBL}$ corresponding to the five-channel audio signal to be reconstructed.

Figure 13:
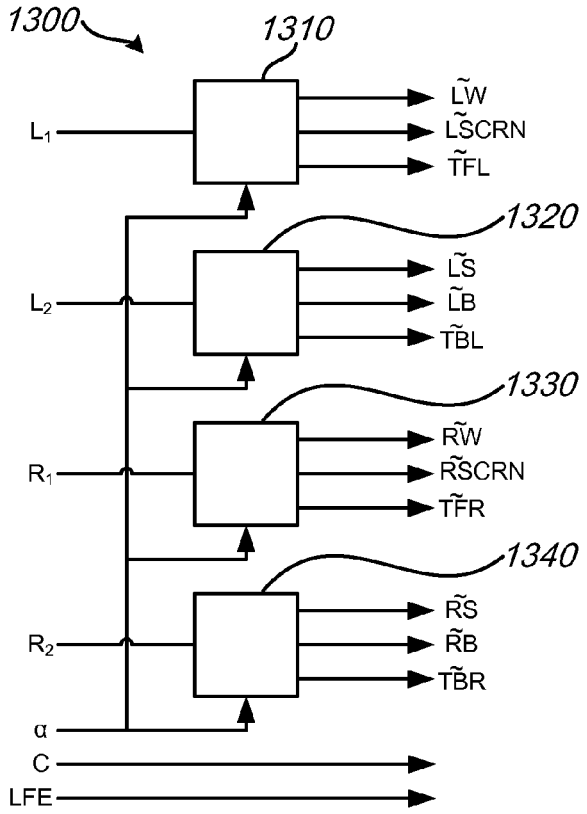
FIG. 13 is a generalized block diagram of a decoding section for reconstructing a 13.1-channel audio signal based on a 5.1-channel signal and associated upmix parameters, according to an example embodiment.

FIG. 13 is a generalized block diagram of a decoding section 1300 for reconstructing a 13.1-channel audio signal based on a 5.1-channel audio signal and associated upmix parameters $\alpha$, according to an example embodiment.

In the present example embodiment, the 13.1-channel audio signal is exemplified by the channels LW (left wide), LSCRN (left screen), TFL (top front left), LS (left side), LB (left back), TBL (top back left), RW (right wide), RSCRN (right screen), TFR (top front right), RS (right side), RB (right back), TBR (top back right), C (center), and LFE (low-frequency effects). The 5.1-channel signal comprises: a downmix signal $L_1$, $L_2$, for which a first channel $L_1$ corresponds to a linear combination of the channels LW, LSCRN, TFL, and for which a second channel $L_2$ corresponds to a linear combination of the channels LS, LB, TBL; an additional downix signal $R_1$, $R_2$ for which a first channel $R_1$ corresponds to a linear combination of the channels RW, RSCRN, TFR, and for which a second channel $R_2$ corresponds to a linear combination of the channels RS, RB, TBR; and the channels C and LFE.

A first upmix section 1310 reconstructs the channels LW, LSCRN and TFL based on the first channel $L_1$ of the downmix signal under control of at least some of the upmix parameters $\alpha$; a second upmix section 1320 reconstructs the channels LS, LB, TBL based on the second channel $L_2$ of the downmix signal under control of at least some of the upmix parameters $\alpha$; a third upmix section 1330 reconstructs the channels RW, RSCRN, TFR based on the first channel $R_1$ of the additional downmix signal under control of at least some of the upmix parameters $\alpha$, and a fourth upmix section 1340 reconstructs the channels RS, RB, TBR based on the second channel $R_2$ of the downmix signal under control of at least some of the upmix parameters α. A reconstructed version $\widetilde{LW}$, $\widetilde{LSCRN}$, $\widetilde{TFL}$, $\widetilde{LS}$, $\widetilde{LB}$, $\widetilde{TBL}$, $\widetilde{RW}$, $\widetilde{RSCRN}$, $\widetilde{TBR}$, $\widetilde{RS}$, $\widetilde{TFR}$, $\widetilde{RB}$ of the 13.1-channel audio signal may be provided as output of the decoding section 1310.

In an example embodiment, the audio decoding system 1000, described with reference to FIG. 10 may comprise the decoding section 1300 in addition to the decoding sections 900 and 1005, or may at least be operable reconstruct the 13.1-channel signal by a method similar to that performed by the decoding section 1300. The signaling S extracted from the bitstream B may for example indicate whether the received 5.1-channel audio signal $L_1$, $L_2$, $R_1$, $R_2$, C, LFE and the associated upmix parameters represent an 11.1-channel signal, as described with reference to FIG. 10, or whether it represents a 13.1-channel audio signal, as described with reference to FIG. 13.

The control section 1009 may detect whether the received signaling S indicates a 11.1 channel configuration or a 13.1 channel configuration and may control other sections of the audio decoding system 1000 to perform parametric reconstruction of either the 11.1-channel audio signal, as described with reference to FIG. 10, or of the 13.1-channel audio signal, as described with reference to FIG. 13. A single coding format may for example be employed for the 13.1-channel configuration, instead of two or three coding formats, as for the 11.1-channel configuration. In case the signaling S indicates a 13.1 channel configuration, the coding format may therefore be implicitly indicated, and there may be no need for the signaling S to explicitly indicate a selected coding format.

It will be appreciated that although the examples embodiments described with reference to FIGS. 1-5 have been formulated in terms of the 11.1-channel audio signal described with reference to FIGS. 6-8, encoding systems may be envisaged which may include any number of encoding sections, and which may be configured to encode any number of M-channel audio signals, where M≥4. Similarly, it will be appreciated that although the example embodiments described with reference to FIGS. 9-12 have been formulated in terms of the 11.1-channel audio signal described with reference to FIGS. 6-8, decoding systems may be envisaged which may include any number of decoding sections, and which may be configured to reconstruct any number of M-channel audio signals, where M≥4.

In some example embodiments, the encoder side may select between all three coding formats $F_1$, $F_2$, $F_3$. In other example embodiments, the encoder side may select between only two coding formats, e.g. the first and second coding formats $F_1$, $F_2$.

Figure 14:
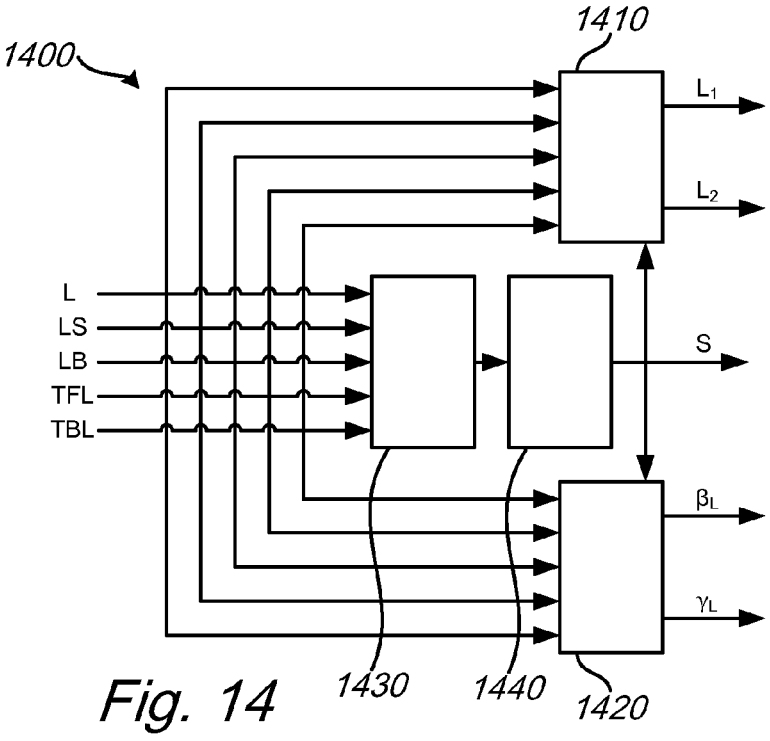
FIG. 14 is a generalized block diagram of an encoding section configured to determine a suitable coding format to be used for encoding an M-channel audio signal (and possible further channels) and, for the chosen format, represent the M-channel audio signal as a two-channel downmix signal and associated upmix parameters.

FIG. 14 is a generalized block diagram of an encoding section 1400 for encoding an M-channel audio signal as a two-channel downmix signal and associated dry and wet upmix coefficients, according to an example embodiment. The encoding section 1400 may be arranged in an audio encoding system of the type shown in FIG. 3. More precisely, it may be arranged in the location occupied by the encoding section 100. As will become clear when the inner workings of the components shown are described, the encoding section 1400 is operable in two distinct coding formats; similar encoding sections may however be implemented, without departing from the scope of the invention, that are operable in three or more coding formats.

The encoding section 1400 comprises a downmix section 1410 and an analysis section 1420. For at least a selected one (see below description of a control section 1430 of the encoding section 1400) of the coding formats $F_1$, $F_2$, which may be one of those described with reference to FIGS. 6-7 or may be different formats, the downmix section 1410 computes, in accordance with the coding format, a two-channel downmix signal $L_1$, $L_2$ based on the five-channel audio signal L, LS, LB, TFL, TBL. In for example the first coding format $F_1$, the first channel $L_1$ of the downmix signal is formed as a linear combination (e.g. a sum) of a first group of channels of the five-channel audio signal L, LS, LB, TFL, TBL, and the second channel $L_2$ of the downmix signal is formed as a linear combination (e.g. a sum) of a second group of channels of the five-channel audio signal L, LS, LB, TFL, TBL. The operation performed by the downmix section 1410 may for example be expressed as equation (1).

For at least said selected one of the coding formats $F_1$, $F_2$, the analysis section 1420 determines a set of dry upmix coefficients $\beta_L$ defining a linear mapping of the respective downmix signal $L_1$, $L_2$ approximating the five-channel audio signal L, LS, LB, TFL, TBL. For each of the coding formats $F_1$, $F_2$, the analysis section 1420 further determines a set of wet upmix coefficients $\gamma_L$, based on the respective computed difference, which together with the dry upmix coefficients $\beta_L$ allows for parametric reconstruction according to equation (2) of the five-channel audio signal L, LS, LB, TFL, TBL from the downmix signal $L_1$, $L_2$ and from a three-channel decorrelated signal determined at a decoder side based on the downmix signal $L_1$, $L_2$. The set of wet upmix coefficients $\gamma_L$ defines a linear mapping of the decorrelated signal such that the covariance matrix of the signal obtained by the linear mapping of the decorrelated signal approximates the difference between the covariance matrix of the five-channel audio signal L, LS, LB, TFL, TBL as received and the covariance matrix of the five-channel audio signal as approximated by the linear mapping of the downmix signal $L_1$, $L_2$. The downmix section 1410 may for example compute the downmix signal $L_1$, $L_2$ in the time domain, i.e. based on a time domain representation of the five-channel audio signal L, LS, LB, TFL, TBL, or in a frequency domain, i.e. based on a frequency domain representation of the five-channel audio signal L, LS, LB, TFL, TBL. It is possible to compute $L_1$, $L_2$ in the time domain at least if the decision on a coding format is not frequency-selective, and thus applies for all frequency components of the M-channel audio signal; this is the currently preferred case.

The analysis section 1420 may for example determine the dry upmix coefficients $\beta_L$ and the wet upmix coefficients $\gamma_L$ based on a frequency-domain analysis of the five-channel audio signal L, LS, LB, TFL, TBL. The frequency-domain analysis may be performed on a windowed section of the M-channel audio signal. For windowing, disjoint rectangular or over-lapping triangular windows may for instance be used. The analysis section 1420 may for example receive the downmix signal $L_1$, $L_2$ computed by the downmix section 1410 (not shown in FIG. 14), or may compute its own version of the downmix signal $L_1$, $L_2$, for the specific purpose of determining the dry upmix coefficients $\beta_L$ and the the wet upmix coefficients $\gamma_L$.

The encoding section 1400 further comprises a control section 1430, which is responsible for selecting a coding format to be currently used. It is not essential that the control section 1430 utilize a particular criterion or particular rationale for deciding on a coding format to be selected. The value of signaling S generated by the control section 1430 indicates the outcome of the control section's 1430 decision-making for a currently considered section (e.g. a time frame) of the M-channel audio signal. The signaling S may be included in a bitstream B produced by the encoding system 300 in which the encoding section 1400 is included, so as to facilitate reconstruction of the encoded audio signal. Additionally, the signaling S is fed to each of the downmix section 1410 and analysis section 1420, to inform these sections of the coding format to be used. Like the analysis section 1420, the control section 1430 may consider windowed sections of the M-channel signal. It is noted for completeness that the downmix section 1410 may operate with 1 or 2 frames' delay and possibly with additional lookahead, with respect to the control section 1430. Optionally, the signaling S may also contain information relating to a cross fade of the downmix signal that the downmix section 1410 produces and/or information relating to a decoder-side interpolation of discrete values of the dry and wet upmix coefficients that the analysis section 1420 provides, so as to ensure synchronicity on a sub-frame time scale.

As an optional component, the encoding section 1400 may include a stabilizer 1440 arranged immediately downstream of the control section 1430 and acting upon its output signal immediately before it is processed by other components. Based on this output signal, the stabilizer 1440 supplies the side information S to downstream components. The stabilizer 1440 may implement the desirable aim of not changing the selected coding format too frequently. For this purpose, the stabilizer 1440 may consider a number of code format selections for past time frames of the M-channel audio signal and ensure that a chosen coding format is maintained for at least a predefined number of time frames. Alternatively, the stabilizer may apply an averaging filter to a number of past coding format selections (e.g., represented as a discrete variable), which may bring about a smoothing effect. As still another alternative, the stabilizer 1440 may comprise a state machine configured to supply side information S for all time frames in a moving time window if the state machine determines that the coding format selection provided by the control section 1430 has remained stable throughout the moving time window. The moving time window may correspond to a buffer storing coding format selections for a number of past time frames. As the skilled person studying this disclosure readily realizes, such stabilization functionalities may need to be accompanied by an increase in the operational delay between the stabilizer 1440 and at least the downmix section 1410 and analysis section 1420. The delay may be implemented by way of buffering sections of the M-channel audio signal.

It is recalled that FIG. 14 is a partial view of the encoding system in FIG. 3. While the components shown in FIG. 14 only relate to the processing of left-side channels L, LS, LB, TFL, TBL, the encoding system processes at least right-side channels R, RS, RB, TFR, TBR as well. For instance, a further instance (e.g., a functionally equivalent replica) of the encoding section 1400 may be operating in parallel to encode a right-side signal including said channels R, RS, RB, TFR, TBR. Although left-side and right-side channels contribute to two separate downmix signals (or at least to separate groups of channels of a common downmix signal), it is preferred to use a common coding format for all channels. This is to say, the control section 1430 within the left-side encoding section 1400 may be responsible for deciding on a common coding format to be used both for left-side and right-side channels; it is then preferable that the control section 1430 has access to the right-side channels R, RS, RB, TFR, TBR as well or to quantities derived from these signals, such as a covariance, a downmix signal etc., and may take these into account when deciding on a coding format to be used. The signaling S is then provided not only to the downmix section 1410 and the analysis section 1420 of the (left-side) control section 1430, but also to the equivalent sections of a right-side encoding section (not shown). Alternatively, the purpose of using a common coding format for all channels may be achieved by letting the control section 1430 itself be common to both a left-side instance of the encoding section 1400 and a right-side instance thereof. In a layout of the type depicted in FIG. 3, the encoding section 1430 may be provided outside both the encoding section 100 and the additional encoding section 303, which are responsible for left-side and right-side channels, respectively, receiving all of the left-side and right-side channels L, LS, LB, TFL, TBL, R, RS, RB, TFR, TBR and outputting signaling S, which indicates a selection of a coding format and is supplied at least to the encoding section 100 and the additional encoding section 303.

Figure 15:
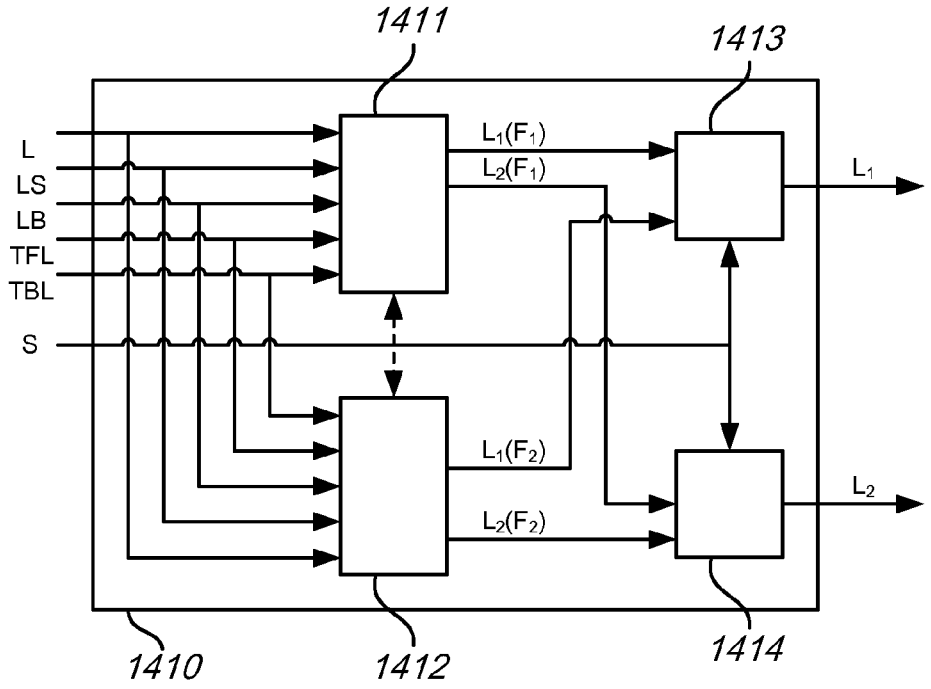
FIG. 15 is a detail of a dual-mode downmix section in the encoding section shown in FIG. 14.

FIG. 15 schematically depicts a possible implementation of a downmix section 1410 configured to alternate, in accordance with the signaling S, between two predefined coding formats $F_1$, $F_2$ and provide a cross fade of these. The downmix section 1410 comprises two downmix subsections 1411, 1412 configured to receive the M-channel audio signal and output a two-channel downmix signal. The two downmix subsections 1411, 1412 may be functionally equivalent copies of one design, although configured with different downmix settings (e.g., values of coefficients for producing the downmix signal $L_1$, $L_2$ based on the M-channel audio signal). In normal operation, the two downmix subsections 1411, 1412 together provide one downmix signal $L_1(F_1)$, $L_2(F_1)$ in accordance with the first coding format $F_1$ and/or one downmix signal $L_1(F_2)$, $L_2(F_2)$ in accordance with the second coding format $F_2$. Downstream of the downmix subsections 1411, 1412, there are arranged a first downmix interpolating section 1413 and a second downmix interpolating section 1414. The first downmix interpolating section 1413 is configured to interpolate, including cross-fading, a first channel $L_1$ of the downmix signal, and the second downmix interpolating section 1414 is configured to interpolate, including cross-fading, a second channel $L_2$ of the downmix signal. The first downmix interpolating section 1413 is operable in at least the following states:

a) first coding format only ($L_1=L_1(F_1)$, as may be used in steady-state operation in the first coding format;
b) second coding format only ($L_1=L_1(F_2)$), as may be used in steady-state operation in the second coding format; and
c) mixing of downmix channels according to both coding formats ($L_1=\alpha_1 L_1(F_1)+\alpha_2 L_1(F_2)$, wherein $0<\alpha_1<1$ and $0<\alpha_2<1$), as may be used in a transition from the first to the second coding format or vice versa.

Mixing state (c) may require that downmix signals are available from both the first and second downmix subsections 1411, 1412. Preferably, the first downmix interpolating section 1413 is operable in a plurality of mixing states (c), so that a transition in fine substeps, or even a quasi-continuous cross fade, is possible. This has the advantage of making a cross fade less perceptible. For example, in an interpolator design where $\alpha_1+\alpha_2=1$, a five-step cross fade is possible if the following values of ($\alpha_1$, $\alpha_2$) are defined: (0.2, 0.8), (0.4, 0.6), (0.6, 0.4), (0.8, 0.2). The second downmix interpolating section 1414 may have identical or similar capabilities.

In a variation to the above embodiment of the downmix section 1410, as suggested by the dashed line in FIG. 15, the signaling S may be fed to the first and second downmix subsections 1411, 1412 as well. As explained above, the generating of the downmix signal associated with the not-selected coding format may then be suppressed. This may reduce the average computational load.

Additionally or alternatively to this variation, the cross fade between downmix signals of two different coding formats may be achieved by cross fading the downmix coefficients. The first downmix subsection 1411 may then be fed by interpolated downmix coefficients, which are produced by a coefficient interpolator (not shown) storing predefined values of downmix coefficients to be used in the available coding formats $F_1$, $F_2$, and receiving as input the signaling S. In this configuration, all of the second downmix subsection 1412 and the first and second interpolating subsections 1413, 1414 may be eliminated or permanently deactivated.

The signaling S that the downmix section 1410 receives is supplied at least to the downmix interpolating sections 1413, 1414, but not necessarily to the downmix subsections 1411, 1412. It is necessary to supply the signaling S to the downmix subsections 1411, 1412 if alternating operation is desired, that is, if the amount of redundant downmixing is to be decreased outside transitions between coding formats. The signaling may be low-level commands, e.g. referring to different operational modes of the downmix interpolating sections 1413, 1414, or may relate to high-level instructions, such as an order to execute a predefined cross fade program (e.g., a succession of the operational modes wherein each has a predefined duration) at an indicated starting point.

Figure 16:
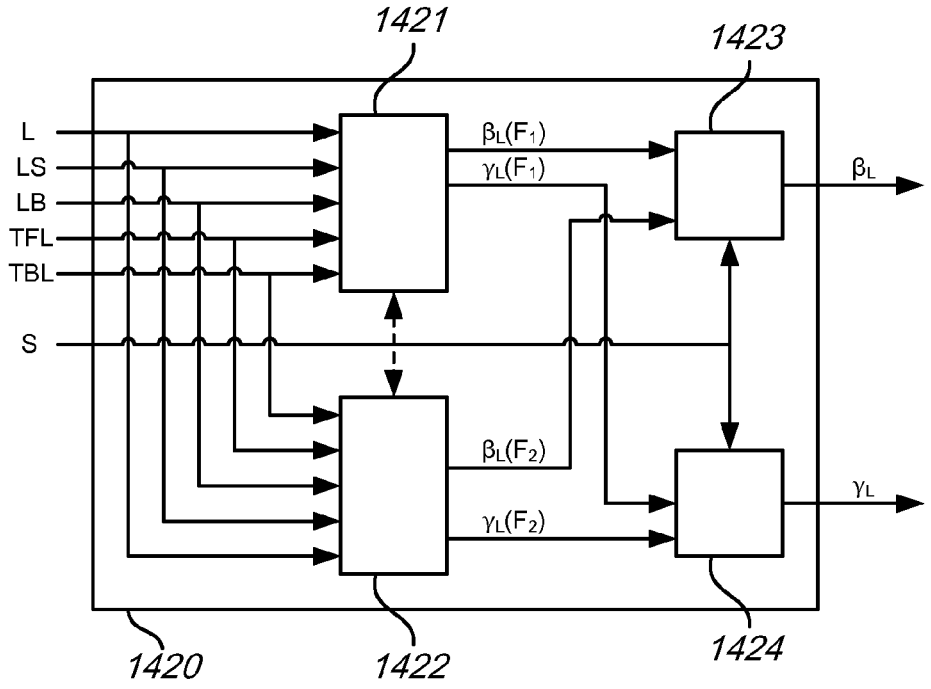
FIG. 16 is a detail of a dual-mode analysis section in the encoding section shown in FIG. 14.

Turning to FIG. 16, there is depicted a possible implementation of an analysis section 1420 configured to alternate, in accordance with the signaling S, between two predefined coding formats $F_1$, $F_2$. The analysis section 1420 comprises two analysis subsections 1421, 1422 configured to receive the M-channel audio signal and output dry and wet upmix coefficients. The two analysis subsections 1421, 1422 may be functionally equivalent copies of one design. In normal operation, the two analysis subsections 1421, 1422 together provide one set of dry and wet upmix coefficients $\beta_L(F_1)$, $\gamma_L(F_1)$ in accordance with the first coding format $F_1$ and/or one set of dry and wet upmix coefficients $\beta_L(F_2)$, $\gamma_L(F_2)$ in accordance with the second coding format $F_2$.

As explained above for the analysis section 1420 as a whole, the current downmix signal may be received from the downmix section 1410, or a duplicate of this signal may be produced in the analysis section 1420. More precisely, the first analysis subsection 1421 may either receive the downmix signal $L_1(F_1)$, $L_2(F_1)$ according to the first coding format $F_1$ from the first downmix subsection 1411 in the downmix section 1410, or may produce a duplicate on its own. Similarly, the second analysis subsection 1422 may either receive the downmix signal $L_1(F_2)$, $L_2(F_2)$ according to the second coding format $F_2$ from the second downmix subsection 1412, or may produce a duplicate of this signal on its own.

Downstream of the analysis sections 1421, 1422, there are arranged a dry upmix coefficient selector 1423 and a wet upmix coefficient selector 1424. The dry upmix coefficient selector 1423 is configured to forward a set of dry upmix coefficients $\beta_L$ from either the first or second analysis subsection 1421, 1422, and the wet upmix coefficient selector 1424 is configured to forward a set of wet upmix coefficients $\gamma_L$ from either the first or second analysis subsection 1421, 1422. The dry upmix coefficient selector 1423 is operable in at least the states (a) and (b) discussed above for the first downmix interpolating section 1413. However, if the encoding system of FIG. 3, of which a portion is here being described, is configured to cooperate with a decoding system which, like the one shown in FIG. 9, performs parametric reconstruction on the basis of interpolated discrete values of upmix coefficients it receives, then there is no need to configure a mixing state like (c) defined for the downmix interpolating sections 1413, 1414. The wet upmix coefficient selector 1424 may have similar capabilities.

The signaling S that the analysis section 1420 receives is supplied at least to the wet and dry upmix coefficient selectors 1423, 1424. It is not necessary for the analysis subsections 1421, 1422 to receive the signaling, although this is advantageous to avoid redundant computation of the upmix coefficients outside transitions. The signaling may be low-level commands, e.g. referring to different operational modes of the dry and wet upmix coefficient selectors 1423, 1424, or may relate to high-level instructions, such as an order to transition from one coding format to another one in a given time frame. As explained above, this preferably does not involve a cross fading operation but may amount to defining values of the upmix coefficients for a suitable point in time, or defining these values to apply at a suitable point in time.

Figure 17:
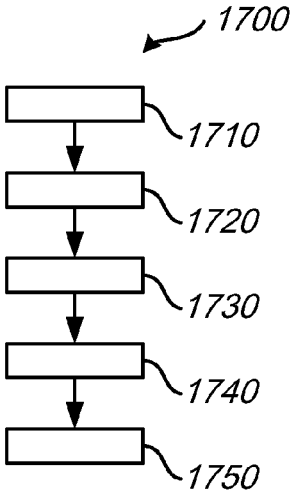
FIG. 17 is a flowchart of an audio encoding method that may be performed by the components shown in FIGS. 14 to 16.

There will now be described a method 1700 being a variation of the method for encoding an M-channel audio signal as a two-channel downmix signal, according to an example embodiment, that was schematically depicted as a flow chart in FIG. 17. The method exemplified here may be performed by an audio encoding system comprising the encoding section 1400 that has been described above with reference to FIGS. 14-16.

The audio encoding method 1700 comprises: receiving 1710 the M-channel audio signal L, LS, LB, TFL, TBL; selecting 1720 one of at least two of the coding formats $F_1$, $F_2$, $F_3$ described with reference to FIGS. 6-8; computing 1730, for the selected coding format, a two-channel downmix signal $L_1$, $L_2$ based on the M-channel audio signal L, LS, LB, TFL, TBL; outputting 1740 the downmix signal $L_1$, $L_2$ of the selected coding format and side information a enabling parametric reconstruction of the M-channel audio signal on the basis of the downmix signal; and outputting 1750 the signaling S indicating the selected coding format. The method repeats, e.g., for each time frame of the M-channel audio signal. If the outcome of the selection 1720 is a different coding format than the one selected immediately previously, then the downmix signal is replaced, for a suitable duration, by a cross fade between downmix signals in accordance with the previous and current coding formats. As already discussed, it is not necessary or not possible to cross-fade the side information, which may be subject to inherent decoder-side interpolation.

It is noted that the method described here may be implemented without one or more of the four steps 430, 440, 450 and 470 depicted in FIG. 4.

IV. Equivalents, Extensions, Alternatives and Miscellaneous

Even though the present disclosure describes and depicts specific example embodiments, the invention is not restricted to these specific examples. Modifications and variations to the above example embodiments can be made without departing from the scope of the invention, which is defined by the accompanying claims only.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs appearing in the claims are not to be understood as limiting their scope.

The devices and methods disclosed above may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out in a distributed fashion, by several physical components in cooperation. Certain components or all components may be implemented as software executed by a digital processor, signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

What is claimed is:

1. An audio decoding method comprising:

receiving a two-channel downmix signal and upmix parameters for parametric reconstruction of an M-channel audio signal having a predefined channel configuration based on the downmix signal, where $M \geq 4$;

receiving signaling indicating a selected one of at least two coding formats of the M-channel audio signal having a predefined channel configuration, wherein the indicated selected coding format switches between the at least two coding formats, and wherein the coding formats correspond to respective different partitions of the channels of the predefined channel configuration of the M-channel audio signal into respective first and second groups of one or more channels, wherein, in the indicated coding format, a first channel of the downmix signal corresponds to a linear combination of the first group of one or more channels of the predefined channel configuration of the M-channel audio signal and a second channel of the downmix signal corresponds to a linear combination of the second group of one or more channels of the predefined channel configuration of the M-channel audio signal;

determining a set of pre-decorrelation coefficients based on the indicated coding format;

computing a decorrelation input signal as a linear mapping of the downmix signal, wherein the set of pre-decorrelation coefficients is applied to the downmix signal, wherein the pre-decorrelation coefficients are determined such that a first channel of the predefined channel configuration of the M-channel audio signal contributes, via the downmix signal, to a first fixed channel of the decorrelation input signal in at least two of the coding formats;

generating a decorrelated signal based on the decorrelation input signal;

determining sets of wet and dry upmix coefficients based on the received upmix parameters and the indicated coding format;

computing a dry upmix signal as a linear mapping of the downmix signal, wherein the set of dry upmix coefficients is applied to the downmix signal;

computing a wet upmix signal as a linear mapping of the decorrelated signal, wherein the set of wet upmix coefficients is applied to the decorrelated signal; and combining the dry and wet upmix signals to obtain a multidimensional reconstructed signal corresponding to the M-channel audio signal to be reconstructed.

2. The audio decoding method of claim 1, wherein the decorrelation input signal and the decorrelated signal each comprises M−2 channels, wherein a channel of the decorrelated signal is generated based on no more than one channel of the decorrelation input signal, and wherein the pre-decorrelation coefficients are determined such that, in each of the coding formats, a channel of the decorrelation input signal receives a contribution from no more than one channel of the downmix signal.

3. The audio decoding method of claim 1, wherein the pre-decorrelation coefficients are determined such that, additionally, a second channel of the M-channel audio signal contributes, via the downmix signal, to a second fixed channel of the decorrelation input signal in at least two of the coding formats.

4. The audio decoding method of claim 1, wherein the pre-decorrelation coefficients are determined such that a pair of channels of the M-channel audio signal contributes, via the downmix signal, to a third fixed channel of the decorrelation input signal in at least two of the coding formats.

5. The audio decoding method of claim 1, further comprising:

in response to detecting a switch of the indicated coding format from a first coding format to a second coding format, performing a gradual transition from pre-decorrelation coefficient values associated with the first coding format to pre-decorrelation coefficient values associated with the second coding format.

6. The audio decoding method of claim 1, wherein the at least two coding formats include a first coding format and a second coding format, wherein each gain controlling a contribution, in the first coding format, from a channel of the M-channel audio signal to one of the linear combinations to which the channels of the downmix signal correspond, coincides with a gain controlling a contribution, in the second coding format, of said channel of the M-channel audio signal to one of the linear combinations to which the channels of the downmix signal correspond.

7. The audio decoding method of claim 1, wherein the M-channel audio signal comprises three channels representing different horizontal directions in a playback environment for the M-channel audio signal, and two channels representing directions vertically separated from those of said three channels in said playback environment.

8. The audio decoding method of claim 7, wherein, in a first coding format, said second group comprises said two channels and/or, wherein, in a first coding format, said first group comprises said three channels and said second group comprises said two channels and/or; wherein, in a second coding format, each of the first and second groups comprises one of said two channels.

9. The audio decoding method of claim 1, wherein, in a particular coding format, said first group consists of N channels, where N≥3, and wherein, in response to the indicated coding format being the particular coding format:

the pre-decorrelation coefficients are determined such that N−1 channels of the decorrelated signal are generated based on the first channel of the downmix signal; and the dry and wet upmix coefficients are determined such that said first group is reconstructed as a linear mapping of the first channel of the downmix signal and said N−1 channels of the decorrelated signal, wherein a subset of the dry upmix coefficients is applied to the first channel of the downmix signal and a subset of the wet upmix coefficients is applied to said N−1 channels of the decorrelated signal.

10. The audio decoding method of claim 9, wherein the received upmix parameters include wet upmix parameters and dry upmix parameters, and wherein determining the sets of wet and dry upmix coefficients comprises:

determining, based on the dry upmix parameters, said subset of the dry upmix coefficients;

populating an intermediate matrix having more elements than the number of received wet upmix parameters, based on the received wet upmix parameters and knowing that the intermediate matrix belongs to a predefined matrix class; and obtaining said subset of the wet upmix coefficients by multiplying the intermediate matrix by a predefined matrix, wherein said subset of the wet upmix coefficients corresponds to the matrix resulting from the multiplication and includes more coefficients than the number of elements in the intermediate matrix.

11. The audio decoding method of claim 10, wherein the predefined matrix and/or the predefined matrix class is associated with the indicated coding format.

12. The audio decoding method of claim 1, further comprising:

receiving signaling indicating one of at least two predefined channel configurations;

in response to detecting the received signaling indicating a first predefined channel configuration, performing the audio decoding method of claim 1; and in response to detecting the received signaling indicating a second predefined channel configuration receiving a two-channel downmix signal and associated upmix parameters, performing parametric reconstruction of a first three-channel audio signal based on a first channel, of the downmix signal and at least some of the upmix parameters, and performing parametric reconstruction of a second three-channel audio signal based on a second channel, of the downmix signal and at least some of the upmix parameters.

13. A non-transitory computer-readable storage medium comprising a sequence of instructions, wherein the instructions, when performed by an audio signal processing device, cause the audio signal processing device to perform the method of claim 1.

14. An audio decoding system comprising:

a decoding section configured to reconstruct an M-channel audio signal having a predefined channel configuration based on a two-channel downmix signal and associated upmix parameters, where M≥4; and a control section configured to receive signaling indicating a selected one of at least two coding formats of the predefined channel configuration of the M-channel audio signal, wherein the indicated selected coding format switches between the at least two coding formats, and wherein the coding formats correspond to respective different partitions of the channels of the predefined channel configuration of the M-channel audio signal into respective first and second groups of one or more channels, wherein, in the indicated coding format, a first channel of the downmix signal corresponds to a linear combination of the first group of one or more channels of the predefined channel configuration of the M-channel audio signal and a second channel of the downmix signal corresponds to a linear combination of the second group of one or more of channels of the predefined channel configuration of the M-channel audio signal, wherein the decoding section comprises:

a pre-decorrelation section configured to determine a set of pre-decorrelation coefficients based on the indicated coding format, and to compute a decorrelation input signal as a linear mapping of the downmix signal, wherein the set of pre-decorrelation coefficients is applied to the downmix signal, and wherein the pre-decorrelation coefficients are determined such that a first channel of the predefined channel configuration of the M-channel audio signal contributes, via the downmix signal, to a first fixed channel of the decorrelation input signal in at least two of the coding formats;

a decorrelating section configured to generate a decorrelated signal based on the decorrelation input signal; and a mixing section configured to:

determine sets of wet and dry upmix coefficients based on the received upmix parameters and the indicated coding format;

compute a dry upmix signal as a linear mapping of the downmix signal, wherein the set of dry upmix coefficients is applied to the downmix signal;

compute a wet upmix signal as a linear mapping of the decorrelated signal, wherein the set of wet upmix coefficients is applied to the decorrelated signal; and combine the dry and wet upmix signals to obtain a multidimensional reconstructed signal corresponding to the M-channel audio signal to be reconstructed.

15. The audio decoding system of claim 14, further comprising an additional decoding section configured to reconstruct an additional M-channel audio signal based on an additional two-channel downmix signal and associated additional upmix parameters, wherein the control section is configured to receive signaling indicating a selected one of at least two coding formats of the additional M-channel audio signal, the coding formats of the additional M-channel audio signal corresponding to respective different partitions of the channels of the additional M-channel audio signal into respective first and second groups of one or more channels, wherein, in the indicated coding format of the additional M-channel audio signal, a first channel of the additional downmix signal corresponds to a linear combination of the first group of one or more channels of the additional M-channel audio signal and a second channel of the additional downmix signal corresponds to a linear combination of the second group of one or more channels of the additional M-channel audio signal, wherein the additional decoding section comprises:

an additional pre-decorrelation section configured to determine an additional set of pre-decorrelation coefficients based on the indicated coding format of the additional M-channel audio signal, and to compute an additional decorrelation input signal as a linear mapping of the additional downmix signal, wherein the additional set of pre-decorrelation coefficients is applied to the additional downmix signal;

an additional decorrelating section configured to generate an additional decorrelated signal based on the additional decorrelation input signal; and an additional mixing section configured to:

determine additional sets of wet and dry upmix coefficients based on the received additional upmix parameters and the indicated coding format of the additional M-channel audio signal;

compute an additional dry upmix signal as a linear mapping of the additional downmix signal, wherein the additional set of dry upmix coefficients is applied to the additional downmix signal;

compute an additional wet upmix signal as a linear mapping of the additional decorrelated signal, wherein the additional set of wet upmix coefficients is applied to the additional decorrelated signal; and combine the additional dry and wet upmix signals to obtain an additional multidimensional reconstructed signal corresponding to the additional M-channel audio signal to be reconstructed.

16. The audio decoding system of claim 14, further comprising:

a demultiplexer configured to extract, from a bitstream, the downmix signal, the upmix parameters associated with the downmix signal, and a discretely coded audio channel; and a single-channel decoding section operable to decode said discretely coded audio channel.

17. An audio encoding method, comprising:

receiving an M-channel audio signal having a predefined channel configuration, where M≥4;

repeatedly selecting one of at least two coding formats corresponding to respective different partitions of the channels of the predefined channel configuration of the M-channel audio signal into respective first and second groups of one or more channels each, wherein each of the coding formats defines a two-channel downmix signal, in which a first channel of the downmix signal is formed as a linear combination of the first group of one or more channels of the predefined channel configuration of the M-channel audio signal, and wherein a second channel of the downmix signal is formed as a linear combination of the second group of one or more channels of the predefined channel configuration of the M-channel audio signal;

for the currently selected coding format, determining a set of dry upmix coefficients and a set of wet upmix coefficients;

computing, in accordance with the currently selected coding format, a two-channel downmix signal based on the M-channel audio signal;

outputting the downmix signal of the currently selected coding format, the downmix signal being segmented into time frames, and side information enabling parametric reconstruction of the M-channel audio signal on the basis of the downmix signal and a decorrelated signal determined based on at least one channel of the downmix signal of the selected coding format, the side information comprising discrete values of the sets of dry and wet upmix coefficients, wherein at least one discrete value per time frame is output; and outputting signaling indicating the currently selected coding format, wherein, in response to a change from a first selected coding format to a second, distinct selected coding format, a downmix signal according to the second selected coding format is computed, and a cross fade of the downmix signal according to the first selected coding format and the downmix signal according to the second selected coding format is output in lieu of the downmix signal, and wherein the parametric reconstruction of the M-channel audio signal between the discrete values is to be based on interpolated values of the sets of dry and wet upmix coefficients according to a predefined interpolation rule, wherein the downmix-signal cross fade and the discrete values of the sets of dry and wet upmix coefficients are output in such manner that said cross fade and interpolation will be synchronous.

18. An audio encoding system comprising an encoding section configured to encode an M-channel audio signal having a predefined channel configuration as a two-channel downmix signal and associated upmix parameters, where M≥4, the encoding section comprising:

a downmix section configured to, for at least one of at least two coding formats corresponding to respective different partitions of the channels of the predefined channel configuration of the M-channel audio signal into respective first and second groups of one or more channels each, compute, in accordance with the coding format, a two-channel downmix signal based on the M-channel audio signal, the downmix signal being segmented into time frames, wherein a first channel of the downmix signal is formed as a linear combination of the first group of one or more channels of the predefined channel configuration of the M-channel audio signal and a second channel of the downmix signal is formed as a linear combination of the second group of one or more predefined channel configuration of the channels of the M-channel audio signal;

a control section configured to repeatedly select one of the coding formats, a downmix interpolator configured to produce a cross fade of the downmix signal according to a first coding format, which has been selected by the control section, and the downmix signal according to a second coding format, which has been selected by the control section immediately after the first coding format, wherein the audio encoding system is configured to, for the currently selected coding format, determine a set of dry upmix coefficients and a set of wet upmix coefficients, and output signaling indicating the currently selected coding format and side information enabling parametric reconstruction of the M-channel audio signal on the basis of the downmix signal and a decorrelated signal determined based on at least one channel of the downmix signal of the selected coding format, the side information comprising discrete values of the sets of dry and wet upmix coefficients, wherein at least one discrete value per time frame is output, and wherein the parametric reconstruction of the M-channel audio signal between the discrete values is to be based on interpolated values of the sets of dry and wet upmix coefficients according to a predefined interpolation rule, wherein the audio encoding system is configured to output the downmix-signal cross fade and the discrete values of the sets of dry and wet upmix coefficients in such manner that said cross fade and interpolation will be synchronous.

19. The audio encoding system of claim 18, configured to further encode an $M_2$-channel audio signal, wherein the control section is configured to repeatedly select one of the coding formats with effect for the M-channel audio signal and the $M_2$-channel audio signal, the system further comprising an additional encoding section, which is communicatively coupled to the control section and is configured to encode the $M_2$-channel audio signal in accordance with the coding format selected by the control section.

20. A non-transitory computer-readable storage medium comprising a sequence of instructions, wherein the instructions, when performed by an audio signal processing device, cause the audio signal processing device to perform the method of claim 18.

* * * * *